US009222670B2

(12) United States Patent
Deng

(10) Patent No.: US 9,222,670 B2
(45) Date of Patent: Dec. 29, 2015

(54) HEATING SYSTEM WITH PRESSURE REGULATOR

(76) Inventor: David Deng, Diamond Bar, CA (US)

( * ) Notice: Subject to any disclaimer, the term of this patent is extended or adjusted under 35 U.S.C. 154(b) by 834 days.

(21) Appl. No.: 13/351,131

(22) Filed: Jan. 16, 2012

(65) Prior Publication Data

US 2012/0196236 A1 Aug. 2, 2012

Related U.S. Application Data

(60) Provisional application No. 61/433,886, filed on Jan. 18, 2011.

(51) Int. Cl.

| | |
|---|---|
| ***F23N 1/00*** | (2006.01) |
| ***F23K 5/00*** | (2006.01) |
| *F23K 5/14* | (2006.01) |
| *G05D 16/10* | (2006.01) |

(52) U.S. Cl.

CPC ..... *F23N 1/007* (2013.01); *F23K 5/002* (2013.01); *F23K 5/147* (2013.01); *F23N 2037/08* (2013.01); *G05D 16/103* (2013.01); *Y10T 137/7796* (2015.04); *Y10T 137/7835* (2015.04); *Y10T 137/7839* (2015.04); *Y10T 137/8733* (2015.04); *Y10T 137/87338* (2015.04); *Y10T 137/87499* (2015.04); *Y10T 137/87555* (2015.04)

(58) Field of Classification Search

CPC ..... F23N 2037/08; F23N 1/007; F23K 5/002; F23K 5/147; G05D 16/103; Y10T 137/8733; Y10T 137/87338; Y10T 137/87499; Y10T 137/87555; Y10T 137/7839; Y10T 137/7796; Y10T 137/7835

USPC ..... 137/497–504, 506, 512.1, 599.01, 137/599.09, 599.11, 601.13, 601.2, 601.21, 137/627.5, 861, 877–881

See application file for complete search history.

(56) References Cited

U.S. PATENT DOCUMENTS

| | | | | | |
|---|---|---|---|---|---|
| 188,740 | A | * | 3/1877 | Kipp et al. | 137/505 |
| 1,639,115 | A | | 8/1927 | Smith | |
| 1,697,865 | A | * | 1/1929 | Hahn et al. | 137/599.09 |
| 1,729,819 | A | * | 10/1929 | Campbell | 137/505 |
| 1,755,639 | A | * | 4/1930 | Fawcett | 137/599.09 |
| 2,088,685 | A | * | 8/1937 | Birch | 137/505.11 |
| 2,319,676 | A | | 5/1943 | Guelson | |

(Continued)

FOREIGN PATENT DOCUMENTS

| | | |
|---|---|---|
| DE | 113 680 C | 11/1899 |
| DE | 1650303 | 9/1970 |

(Continued)

OTHER PUBLICATIONS

International Search Report and Written Opinion for International Application No. PCT/US2012/021455, Notification mailed Oct. 8, 2013.

(Continued)

*Primary Examiner* — William McCalister

(74) *Attorney, Agent, or Firm* — Knobbe Martens Olson & Bear LLP

(57) ABSTRACT

A heating system can include certain pressure sensitive features. These features can be configured to change from a first position to a second position based on a pressure of a fuel flowing into the feature. These features can include, fuel selector valves, pressure regulators, burner nozzles, and oxygen depletion sensor nozzles, among other features.

12 Claims, 17 Drawing Sheets

(56) References Cited

U.S. PATENT DOCUMENTS

| | | | | |
|---|---|---|---|---|
| 2,380,956 | A | 8/1945 | Evarts | |
| 2,422,368 | A | 6/1947 | Bay | |
| 2,464,697 | A | 3/1949 | Logan et al. | |
| 2,518,894 | A | 8/1950 | Humbarger et al. | |
| 2,556,337 | A | 6/1951 | Paille | |
| 2,560,245 | A * | 7/1951 | Ramsaur et al. | 165/103 |
| 2,588,485 | A | 3/1952 | Clarke et al. | |
| 2,630,821 | A | 3/1953 | Arey | |
| 2,661,157 | A | 12/1953 | Reichelderfer | |
| 2,687,140 | A | 8/1954 | St. Clair | |
| 2,905,361 | A | 9/1959 | Noall | |
| 2,969,924 | A | 1/1961 | William | |
| 3,001,541 | A | 9/1961 | St. Clair | |
| 3,032,096 | A | 5/1962 | Stout et al. | |
| 3,083,721 | A * | 4/1963 | Matthews et al. | 137/505.12 |
| 3,331,392 | A | 7/1967 | Davidson et al. | |
| 3,386,656 | A | 6/1968 | Bergquist | |
| 3,430,655 | A | 3/1969 | Forney | |
| 3,578,015 | A | 5/1971 | Andersen | |
| 3,578,243 | A * | 5/1971 | Love | 236/80 R |
| 3,747,629 | A | 7/1973 | Bauman | |
| 3,802,454 | A * | 4/1974 | Kleuters | 137/565.35 |
| 3,814,570 | A | 6/1974 | Guigues et al. | |
| 3,829,279 | A | 8/1974 | Qualley et al. | |
| 3,939,871 | A | 2/1976 | Dickson | |
| 4,021,190 | A | 5/1977 | Dickson | |
| 4,101,257 | A | 7/1978 | Straitz, III | |
| 4,171,712 | A | 10/1979 | DeForrest | |
| 4,181,154 | A | 1/1980 | Oley et al. | |
| 4,290,450 | A | 9/1981 | Swanson | |
| 4,301,825 | A | 11/1981 | Simko | |
| 4,359,284 | A | 11/1982 | Kude et al. | |
| 4,465,456 | A | 8/1984 | Hynek et al. | |
| 4,515,554 | A | 5/1985 | Sirand | |
| 4,653,530 | A | 3/1987 | Kelly | |
| 4,660,595 | A | 4/1987 | Kuster et al. | |
| 4,718,448 | A | 1/1988 | Love et al. | |
| 4,768,543 | A | 9/1988 | Wienke et al. | |
| 4,796,652 | A | 1/1989 | Hafla | |
| 4,930,538 | A | 6/1990 | Browne | |
| 4,958,771 | A | 9/1990 | Klomp | |
| 5,172,728 | A | 12/1992 | Tsukazaki | |
| 5,379,794 | A | 1/1995 | Brown | |
| 5,413,141 | A | 5/1995 | Dietiker | |
| 5,458,294 | A | 10/1995 | Zachary et al. | |
| 5,520,206 | A * | 5/1996 | Deville | 137/12 |
| 5,584,680 | A | 12/1996 | Kim | |
| 5,591,024 | A | 1/1997 | Eavenson et al. | |
| 5,706,859 | A | 1/1998 | Backlund | |
| 5,807,098 | A | 9/1998 | Deng | |
| 5,944,257 | A * | 8/1999 | Dietiker et al. | 236/80 B |
| 5,971,746 | A | 10/1999 | Givens et al. | |
| 5,975,112 | A | 11/1999 | Ohmi et al. | |
| 5,988,204 | A | 11/1999 | Reinhardt et al. | |
| 6,035,893 | A | 3/2000 | Ohmi et al. | |
| 6,135,063 | A | 10/2000 | Welden | |
| 6,257,270 | B1 | 7/2001 | Ohmi et al. | |
| 6,354,078 | B1 | 3/2002 | Karlsson et al. | |
| 6,402,052 | B1 | 6/2002 | Murawa | |
| 6,607,854 | B1 | 8/2003 | Rehg et al. | |
| 6,705,342 | B2 * | 3/2004 | Santinanavat et al. | 137/489 |
| 6,786,194 | B2 | 9/2004 | Koegler et al. | |
| 6,832,625 | B2 * | 12/2004 | Ford | 137/495 |
| 6,904,873 | B1 | 6/2005 | Ashton | |
| 6,910,496 | B2 | 6/2005 | Strom | |
| 6,938,634 | B2 | 9/2005 | Dewey, Jr. | |
| 6,941,962 | B2 | 9/2005 | Haddad | |
| 7,013,886 | B2 | 3/2006 | Deng | |
| 7,044,729 | B2 | 5/2006 | Ayastuy et al. | |
| 7,143,783 | B2 * | 12/2006 | Emke et al. | 137/512.1 |
| 7,225,830 | B1 | 6/2007 | Kershaw | |
| 7,386,981 | B2 | 6/2008 | Zielinski et al. | |
| 7,434,447 | B2 | 10/2008 | Deng | |
| 7,487,888 | B1 | 2/2009 | Pierre, Jr. | |
| 7,533,656 | B2 | 5/2009 | Dingle | |
| 7,600,529 | B2 | 10/2009 | Querejeta | |
| 7,607,426 | B2 | 10/2009 | Deng | |
| 7,617,841 | B2 * | 11/2009 | Zimpfer et al. | 137/505.13 |
| 7,654,820 | B2 | 2/2010 | Deng | |
| 7,677,236 | B2 | 3/2010 | Deng | |
| 8,011,920 | B2 | 9/2011 | Deng | |
| 8,123,150 | B2 | 2/2012 | Khan et al. | |
| 8,152,515 | B2 | 4/2012 | Deng | |
| 2006/0096644 | A1 | 5/2006 | Goldfarb et al. | |
| 2006/0236986 | A1 | 10/2006 | Fujisawa et al. | |
| 2007/0154856 | A1 | 7/2007 | Hallit et al. | |
| 2008/0149872 | A1 | 6/2008 | Deng | |
| 2008/0153045 | A1 | 6/2008 | Deng | |
| 2008/0223465 | A1 | 9/2008 | Deng | |
| 2010/0310997 | A1 | 12/2010 | Mugica Odriozola et al. | |
| 2010/0319789 | A1 | 12/2010 | Erdmann et al. | |
| 2010/0330513 | A1 | 12/2010 | Deng | |
| 2011/0226355 | A1 | 9/2011 | Benvenuto et al. | |
| 2011/0284791 | A1 | 11/2011 | Vasquez et al. | |

FOREIGN PATENT DOCUMENTS

| | | | |
|---|---|---|---|
| DE | 1959677 | | 5/1971 |
| DE | 3700233 | A1 | 7/1988 |
| DE | 19543018 | | 5/1997 |
| EP | 0509626 | | 10/1992 |
| EP | 1326050 | | 7/2003 |
| EP | 1970625 | | 9/2008 |
| FR | 2151367 | | 3/1973 |
| GB | 19845 | | 2/1913 |
| GB | 1136468 | | 12/1968 |
| GB | 2210155 | | 6/1989 |
| GB | 2241180 | | 8/1991 |
| GB | 2298039 | | 8/1996 |
| JP | 03 230015 | A | 10/1991 |
| JP | 05-256422 | | 5/1993 |
| JP | 11192166 | | 7/1999 |
| JP | 2003 056845 | A | 2/2003 |
| JP | 2003 074837 | A | 3/2003 |
| JP | 2003-74838 | | 12/2003 |

OTHER PUBLICATIONS

International Search Report and Written Opinion for International Application No. PCT/US2011/039521, Notification mailed Mar. 18, 2013.

International Search Report and Written Opinion for International Application No. PCT/US2011/039524, Notification mailed Mar. 13, 2013.

International Search Report and Written Opinion for International Application No. PCT/US2011/039525, Notification mailed Apr. 5, 2013.

International Search Report and Written Opinion for International Application No. PCT/US2011/039526, Notification mailed Mar. 28, 2013.

* cited by examiner

HEATING SYSTEM WITH PRESSURE REGULATOR

CROSS-REFERENCE TO RELATED APPLICATIONS

This application claims the benefit of U.S. Provisional Application No. 61/433,886 filed on Jan. 18, 2011 and this application is also related to U.S. Application No. 61/421,541, filed Dec. 9, 2010, (PROCUSA.070PR3). The above applications are incorporated by reference herein and made a part of this specification.

BACKGROUND OF THE INVENTION

1. Field of the Invention

Certain embodiments disclosed herein relate generally to a heating source for use in a gas appliance. Aspects of certain embodiments may be particularly adapted for single fuel, dual fuel or multi-fuel use. The gas appliance can include, but is not limited to: heaters, boilers, dryers, washing machines, ovens, fireplaces, stoves, etc.

2. Description of the Related Art

Many varieties of heating sources, such as heaters, boilers, dryers, washing machines, ovens, fireplaces, stoves, and other heat-producing devices utilize pressurized, combustible fuels. However, such devices and certain components thereof have various limitations and disadvantages.

SUMMARY OF THE INVENTION

According to some embodiments a heating system can include any number of different components such as a fuel selector valve, a pressure regulator, a control valve, a burner nozzle, a burner, and/or an oxygen depletion sensor. In addition, a heating system can be a single fuel, dual fuel or multi-fuel heating system. For example, the heating system can be configured to be used with one or more of natural gas, liquid propane, well gas, city gas, and methane.

In some embodiments a heating system can comprise a pressure regulator for regulating the pressure of a fluid flow. In some embodiments, the heating system can be a dual fuel heating system such that the fluid can be one of two different fuels each known to flow within a different predetermined pressure range.

A pressure regulator can comprise a housing, an inlet in the housing, an outlet in the housing, and two pathways through the housing. A first pathway can be within the housing and between the inlet and the outlet. The first pathway can regulate pressure of the fluid flow through the housing within a first pressure range. A second pathway can be within the housing and between the inlet and the outlet. The second pathway can regulate pressure of the fluid flow through the housing within a second pressure range. The pressure ranges can be different.

In some embodiments, a pressure regulator can be configured to not require a user to determine whether the fluid flow will travel between the inlet and the outlet through the first pathway or the second pathway. Rather, the pressure regulator can determine whether the fluid flow will travel between the inlet and the outlet through the first pathway or the second pathway based on the fluid flow pressure.

A pressure regulator according to some embodiments can regulate a fuel within a predetermined pressure range flowing through the pressure regulator, the fuel selected from a group of different fuels each known to flow within different predetermined pressure ranges. A pressure regulator can comprise an outer housing having an inlet configured to receive a flow of fuel into the pressure regulator and an outlet configured to discharge the flow of fuel out of the pressure regulator, a first pathway between the inlet and the outlet through the outer housing, and a second pathway between the inlet and the outlet through the outer housing different from the first pathway.

A pressure regulator can be configured such that the flow of fuel through the pressure regulator can flow through either a first pathway or a second pathway and the pathway selected can determine the pressure range in which the pressure regulator will regulate the flow of fuel. A pressure regulator can further be configured such that the pressure of the flow of fuel prior to regulation selects the pathway through the outer housing.

A pressure regulator can also include various valves within the pressure regulator. For example, a pressure selectable valve can be configured to open within a predetermined pressure range and close within a predetermined pressure range to thereby direct flow to either the first pathway or the second pathway. One or more diaphragms can also be used as valves.

A first diaphragm can be configured to regulate the fluid flow through the first pathway. A second diaphragm can be configured to regulate the fluid flow through the second pathway. In some embodiments, the open pressure selectable valve can be configured to direct fluid flow to the first diaphragm. In some embodiments, the closed pressure selectable valve can cause fluid to flow to the second diaphragm.

Some pressure regulators comprise a housing, an inlet, an outlet, a first valve comprising a valve member and a first biasing device, a second valve comprising a first diaphragm and a second biasing device, and a third valve comprising a second diaphragm and a third biasing device. The inlet can be configured for fluid communication with the first valve and the third valve such that fluid entering the inlet at a first pressure can flow through the first valve to the second valve, open the second valve and flow through the second valve to the outlet, fluid entering the inlet at a second pressure can open and flow through the third valve to the outlet.

In some embodiments, a heating system, in addition to a pressure regulator, can also include a burner, a nozzle, and a control valve. The outlet of the pressure regulator can be configured to direct the flow of fluid to the control valve and the control valve can be configured to control the flow of fluid to the nozzle.

BRIEF DESCRIPTION OF THE DRAWINGS

Various embodiments are depicted in the accompanying drawings for illustrative purposes, and should in no way be interpreted as limiting the scope of the inventions, in which like reference characters denote corresponding features consistently throughout similar embodiments.

FIG. 3A illustrates a dual fuel heating assembly. FIG. 3B shows another dual fuel heating assembly. FIG. 3C illustrates an unregulated heating assembly.

DETAILED DESCRIPTION OF THE PREFERRED EMBODIMENT

Many varieties of space heaters, wall heaters, stoves, fireplaces, fireplace inserts, gas logs, and other heat-producing devices employ combustible fluid fuels, such as liquid propane and natural gas. The term "fluid," as used herein, is a broad term used in its ordinary sense, and includes materials or substances capable of fluid flow, such as, for example, one or more gases, one or more liquids, or any combination thereof. Fluid-fueled units, such as those listed above, generally are designed to operate with a single fluid fuel type at a specific pressure or within a range of pressures. For example, some fluid-fueled heaters that are configured to be installed on a wall or a floor operate with natural gas at a pressure in a range from about 3 inches of water column to about 6 inches of water column, while others are configured to operate with liquid propane at a pressure in a range from about 8 inches of water column to about 12 inches of water column. Similarly, some gas fireplaces and gas logs are configured to operate with natural gas at a first pressure, while others are configured to operate with liquid propane at a second pressure that is different from the first pressure. As used herein, the terms "first" and "second" are used for convenience, and do not connote a hierarchical relationship among the items so identified, unless otherwise indicated.

Certain advantageous embodiments disclosed herein reduce or eliminate various problems associated with devices having heating sources that operate with only a single type of fuel source. Furthermore, although certain of the embodiments described hereafter are presented in a particular context, the apparatus and devices disclosed and enabled herein can benefit a wide variety of other applications and appliances.

Figure 1:
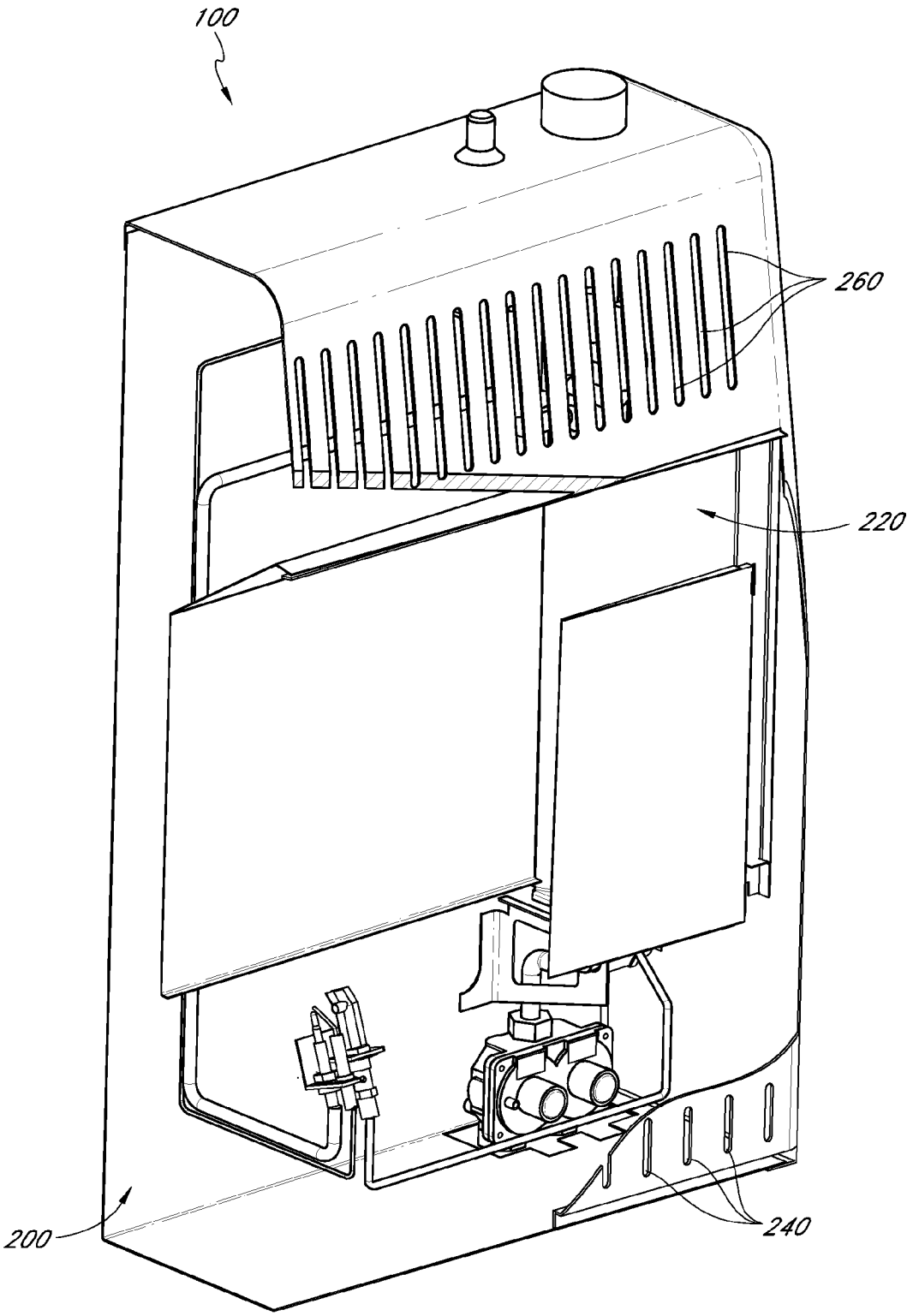
FIG. 1 is a perspective cutaway view of a portion of one embodiment of a heater configured to operate using either a first fuel source or a second fuel source.

FIG. 1 illustrates one embodiment of a heater 100. The heater 100 can be a vent-free infrared heater, a vent-free blue flame heater, or some other variety of heater, such as a direct vent heater. Some embodiments include boilers, stoves, dryers, fireplaces, gas logs, etc. Other configurations are also possible for the heater 100. In many embodiments, the heater 100 is configured to be mounted to a wall or a floor or to otherwise rest in a substantially static position. In other embodiments, the heater 100 is configured to move within a limited range. In still other embodiments, the heater 100 is portable.

The heater 100 can comprise a housing 200. The housing 200 can include metal or some other suitable material for providing structure to the heater 100 without melting or otherwise deforming in a heated environment. In the illustrated embodiment, the housing 200 comprises a window 220, one or more intake vents 240 and one or more outlet vents 260. Heated air and/or radiant energy can pass through the window 220. Air can flow into the heater 100 through the one or more intake vents 240 and heated air can flow out of the heater 100 through the outlet vents 260.

Within the housing 200, the heater 100, or other gas appliance, can include a heating assembly or heating source 10. A heating assembly 10 can include at least one or more of the components described herein.

Figure 2:
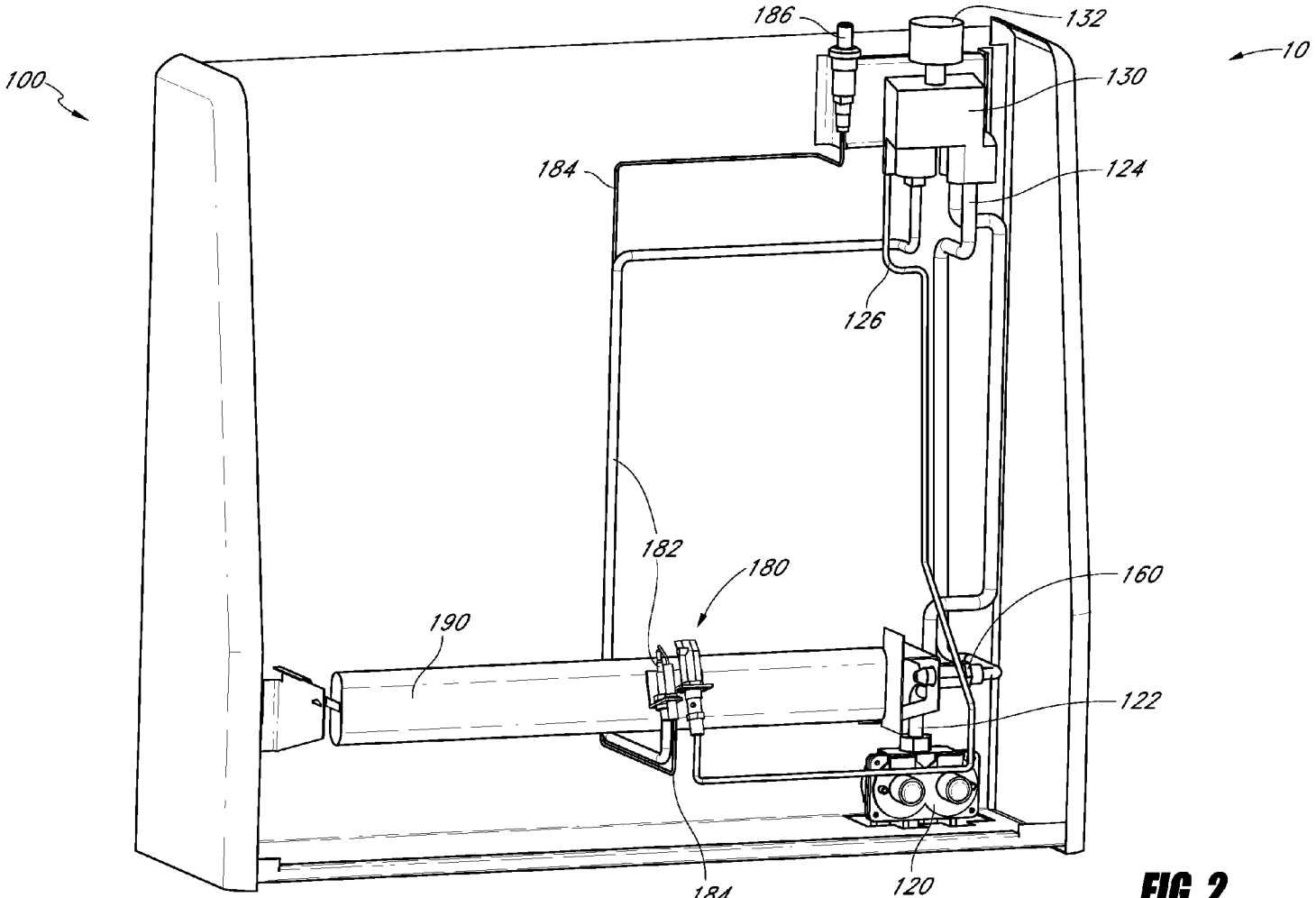
FIG. 2 is a perspective cutaway view of the heater of FIG. 1.

With reference to FIG. 2, in certain embodiments, the heater 100 includes a regulator 120. The regulator 120 can be coupled with an output line or intake line, conduit, or pipe 122. The intake pipe 122 can be coupled with a control valve 130, which, in some embodiments, includes a knob 132. As illustrated, the control valve 130 is coupled to a fuel supply pipe 124 and an oxygen depletion sensor (ODS) pipe 126. The fuel supply pipe 124 can be coupled with a nozzle 160. The oxygen depletion sensor (ODS) pipe 126 can be coupled with an ODS 180. In some embodiments, the ODS comprises a thermocouple 182, which can be coupled with the control valve 130, and an igniter line 184, which can be coupled with an igniter switch 186. Each of the pipes 122, 124, and 126 can define a fluid passageway or flow channel through which a fluid can move or flow.

In some embodiments, including the illustrated embodiment, the heater 100 comprises a burner 190. The ODS 180 can be mounted to the burner 190, as shown. The nozzle 160 can be positioned to discharge a fluid, which may be a gas, liquid, or combination thereof into the burner 190. For purposes of brevity, recitation of the term "gas or liquid" hereafter shall also include the possibility of a combination of a gas and a liquid.

Where the heater 100 is a dual fuel heater, either a first or a second fluid is introduced into the heater 100 through the regulator 120. Still referring to FIG. 2, the first or the second fluid proceeds from the regulator 120 through the intake pipe 122 to the control valve 130. The control valve 130 can permit a portion of the first or the second fluid to flow into the fuel supply pipe 124 and permit another portion of the first or the second fluid to flow into the ODS pipe 126. From the control valve 130, the first or the second fluid can proceed through the fuel supply pipe 124, through the nozzle 160 and is delivered to the burner 190. In addition, a portion of the first or the second fluid can proceed through the ODS pipe 126 to the ODS 180. Other configurations are also possible.

Figure 3B:
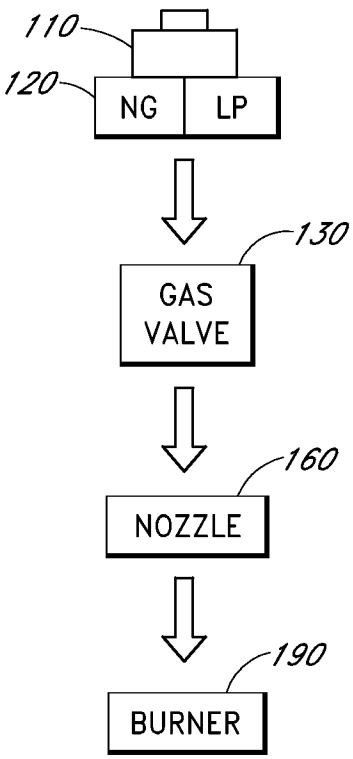
FIGS. 3A-C show some of the various possible combinations of components of a heating assembly 10.
Figure 3A:
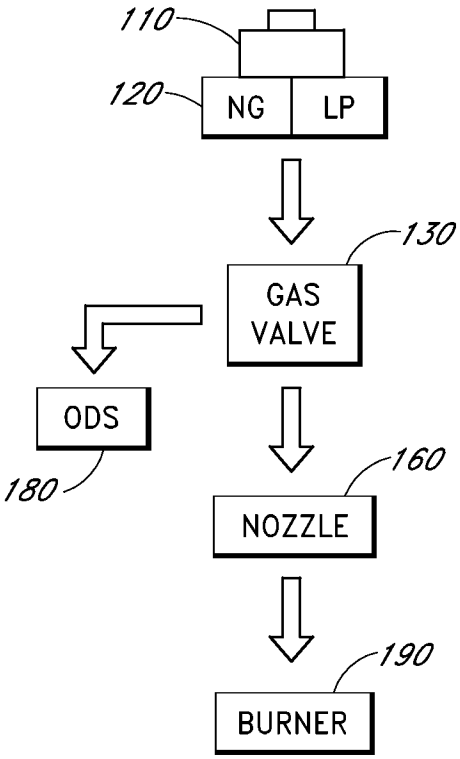
Figure 3C:
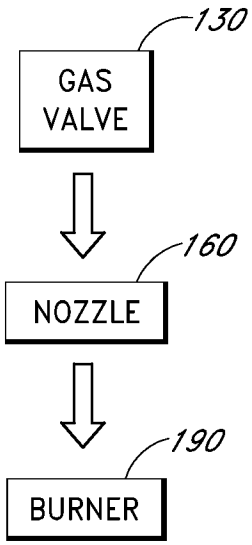

FIGS. 3A-C show some of the various possible combinations of components of a heating assembly 10. Such heating assemblies can be made to be single fuel, dual fuel or multi-fuel gas appliances. For example, the heating assembly 10 can be made so that the installer of the gas appliance can connect the assembly to one of two fuels, such as either a supply of natural gas (NG) or a supply of propane (LP) and the assembly will desirably operate in the standard mode (with respect to efficiency and flame size and color) for either gas.

FIG. 3A illustrates a dual fuel system, such as a vent free heater. In some embodiments, a dual fuel heating assembly can include a fuel selector valve 110, a regulator 120, a control valve or gas valve 130, a nozzle 160, a burner 190 and an ODS 180. The arrows indicate the flow of fuel through the assembly. As can be seen in FIG. 3B, a dual fuel heating assembly, such as a regulated stove or grill, can have similar components to the heating assembly shown in FIG. 3A, but without the ODS. Still further heating assemblies, such as shown in FIG. 3C, may not have a fuel selector valve 110 or a regulator 120. This gas system is unregulated and can be an unregulated stove or grill, among other appliances. The unregulated system can be single fuel, dual fuel or multi-fuel. In some embodiments, and as described in more detail below, one or more of the fuel selector valve, ODS and nozzle, in these and in other embodiments can function in a pressure sensitive manner.

Figure 4A:
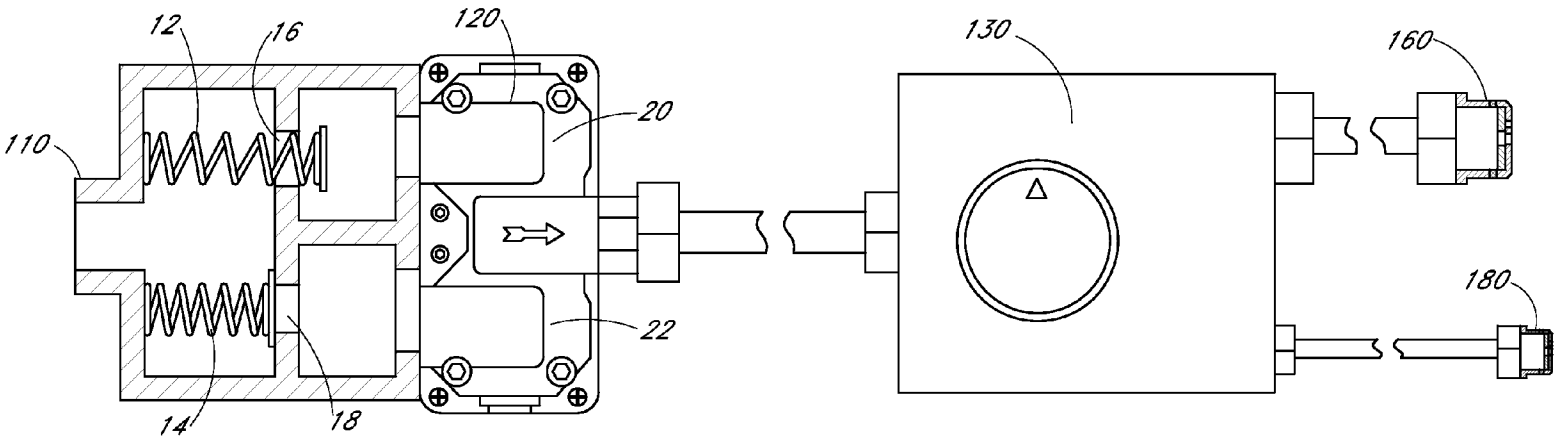
FIGS. 4A-B illustrate an embodiment of a heating assembly in schematic, showing a first configuration for liquid propane and a second configuration for natural gas.
Figure 4B:
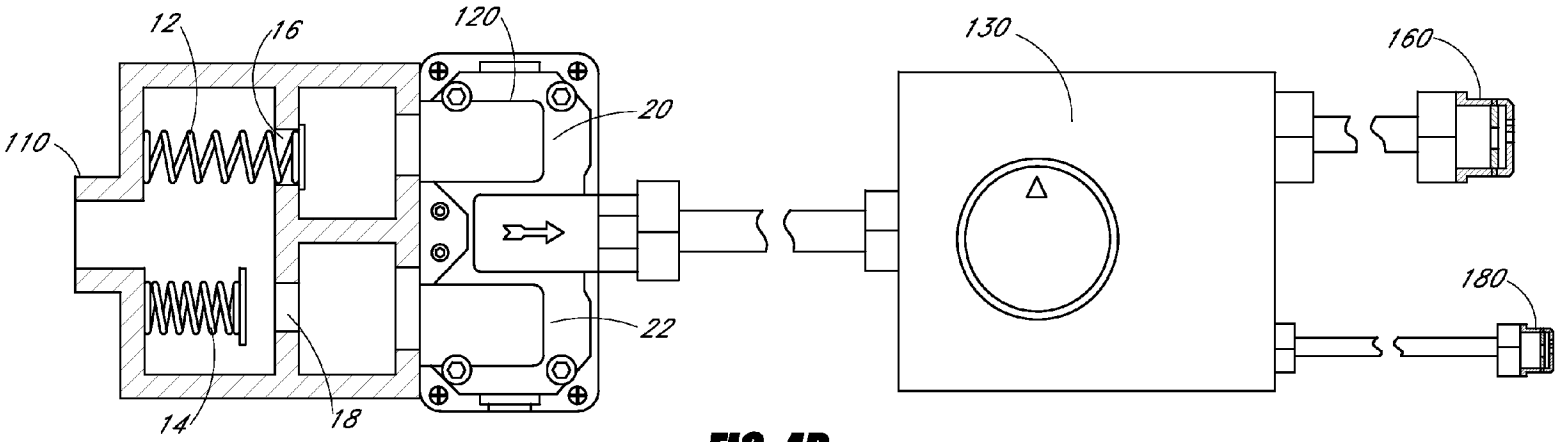

For example, turning to FIGS. 4A-B, a schematic representation of a heating assembly is shown first in a state for liquid propane (FIG. 4A) and second in a state for natural gas (FIG. 4B). Looking at the fuel selector valve 110, it can be seen that the pressure of the fluid flow through the valve 110 can cause the gate, valve or door 12, 14 to open or close, thus establishing or denying access to a channel 16, 18 and thereby to a pressure regulator 20, 22. The gate, valve or door 12, 14 can be biased to a particular position, such as being spring loaded to bias the gate 12 to the closed position and the gate 14 to the open position. In FIG. 4A, the gate 12 has been forced to open channel 16 and gate 14 has closed channel 18. This can provide access to a pressure regulator 20 configured to regulate liquid propane, for example. FIG. 4B shows the fuel selector valve 110 at a rest state where the pressure of the flow is not enough to change to state of the gates 12, 14 and channel 18 is open to provide access to pressure regulator 22, which can be configured to regulate natural gas, for example. As will be described herein after, the nozzle 160 and the ODS 180 can be configured to function in similar ways so that the pressure of the fluid flow can determine a path through the component. For example, the natural gas state (FIG. 4B) can allow more fluid flow than the liquid propane state (FIG. 4A) as represented by the arrows.

Figure 5:
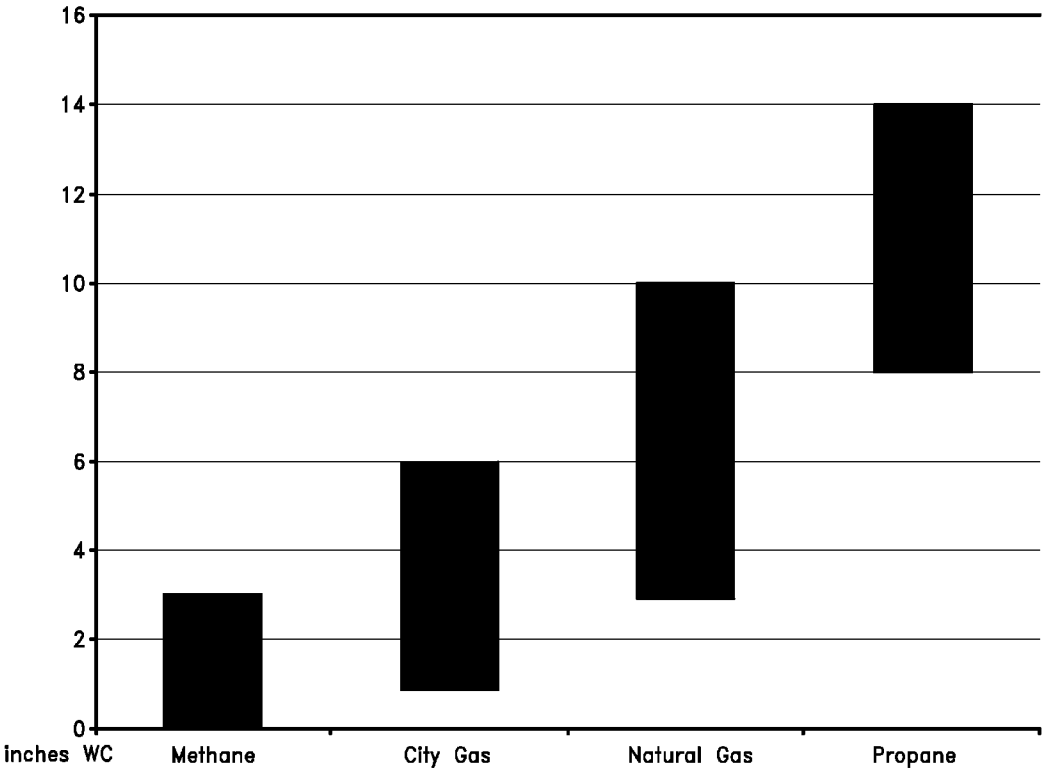
FIG. 5 is a chart showing typical gas pressures of different fuels.

Different fuels are generally run at different pressures. FIG. 5 shows four different fuels: methane, city gas, natural gas and liquid propane; and the typical pressure range of each particular fuel. The typical pressure range can mean the typical pressure range of the fuel as provided by a container, a gas main, a gas pipe, etc. and for consumer use, such as the gas provided to an appliance. Thus, natural gas may be provided to a home gas oven within the range of 3 to 10 inches of water column. The natural gas can be provided to the oven through piping connected to a gas main. As another example, propane may be provided to a barbeque grill from a propane tank with the range of 8 to 14 inches of water column. The delivery pressure of any fuel may be further regulated to provide a more certain pressure range or may be unregulated. For example, the barbeque grill may have a pressure regulator so that the fuel is delivered to the burner within the range of 10 to 12 inches of water column rather than within the range of 8 to 14 inches of water column.

As shown in the chart, city gas can be a combination of one or more different gases. As an example, city gas can be the gas typically provided to houses and apartments in China, and certain other countries. At times, and from certain sources, the combination of gases in city gas can be different at any one given instant as compared to the next.

Because each fuel has a typical range of pressures that it is delivered at, these ranges can advantageously be used in a heating assembly to make certain selections in a pressure sensitive manner. Further, certain embodiments may include one or more pressure regulators and the pressure of the fluid flow downstream of the pressure regulator can be generally known so as to also be able to make certain selections or additional selections in a pressure sensitive manner.

Figure 6:
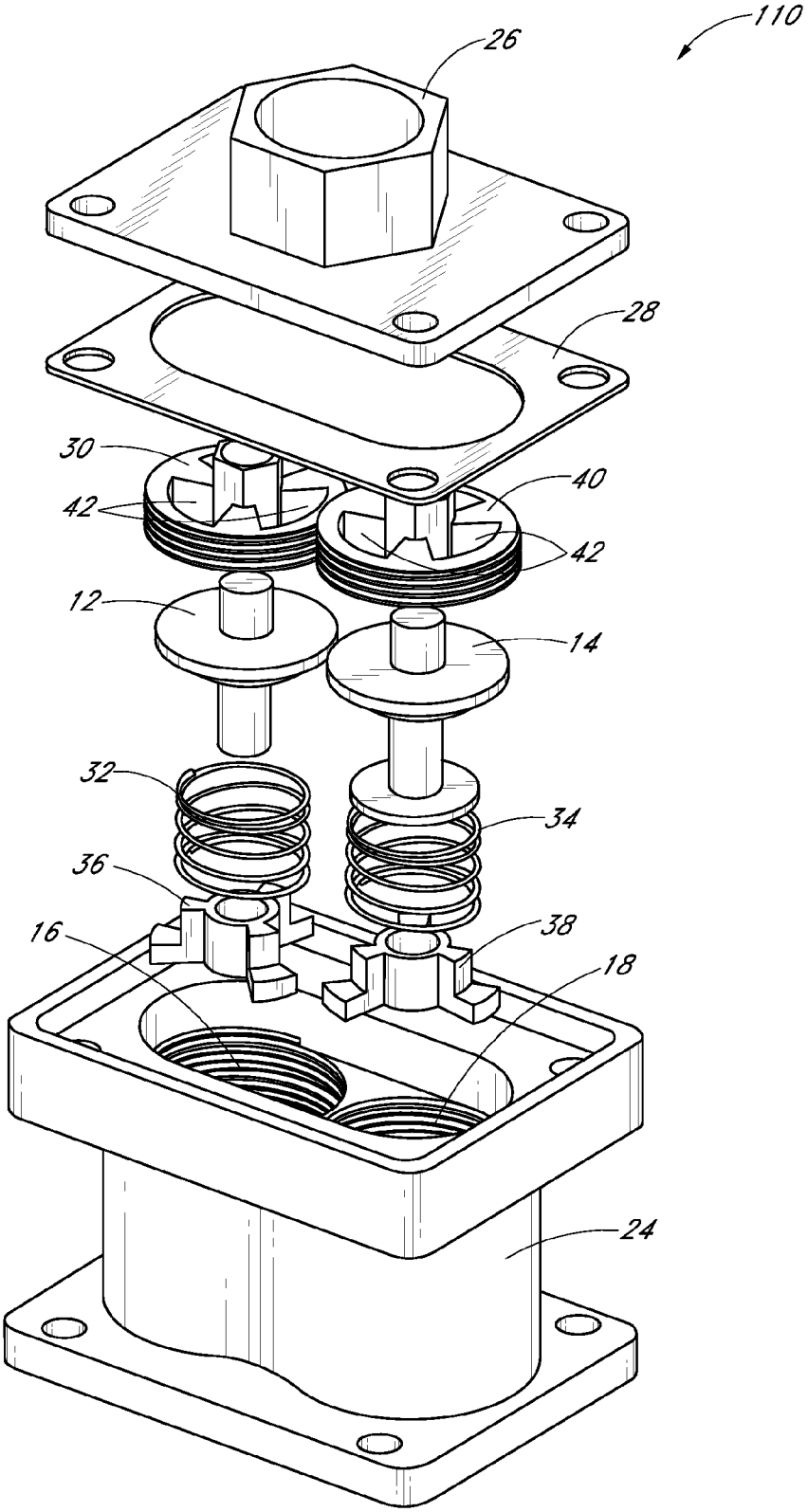
FIG. 6 is an exploded view of an embodiment of a fuel selector valve.

FIG. 6 illustrates the components of an embodiment of a fuel selector valve 110. The fuel selector valve 110 can be for selecting between two different fuels. The fuel selector valve 110 can have a first mode configured to direct a flow of a first fuel (such as natural gas or NG) in a first path through the fuel selector valve and a second mode configured to direct a flow of a second fuel (such as liquid propane or LP) in a second path through the fuel selector valve. This can be done in many different ways such as the opening and/or closing of one or more valves, gates, or doors 12, 14 to establish various flow paths through the fuel selector valve 110. The opening and/or closing of one or more valves, gates, or doors can be performed in a pressure sensitive manner, as explained below.

As illustrated, the fuel selector valve 110 of FIGS. 6-8B includes a main housing 24, a fuel source connection 26, a gasket 28 and valves 12, 14. A heating assembly 10 can connect to a fuel source at the fuel source connection 26. The fuel source connection 26 can be threaded or otherwise configured to securely connect to a fuel source. The main housing 24 can define channels 16, 18 and the valves 12, 14 can reside within the channels 16, 18 in the main housing 24. The housing 24 can be a single piece or a multi-piece housing.

Figure 8A:
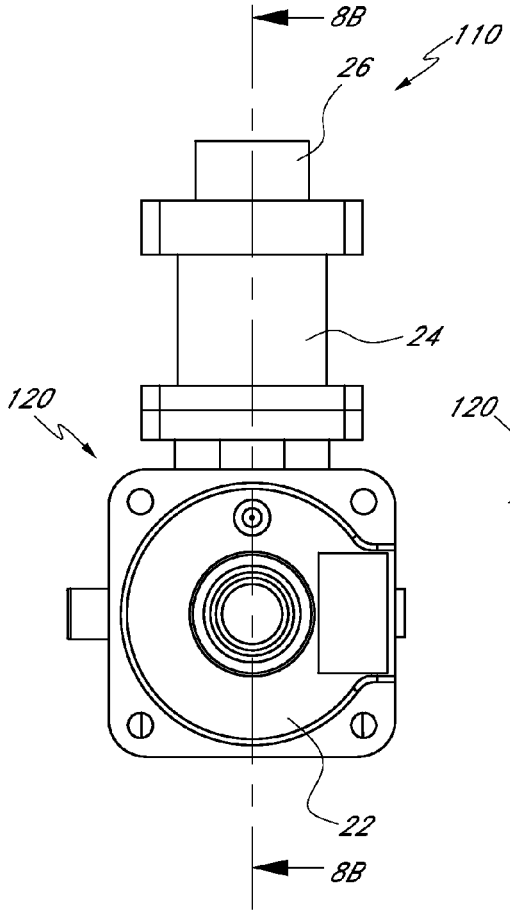
FIG. 8A is a side view of an embodiment of a fuel selector valve and pressure regulator.
Figure 8B:
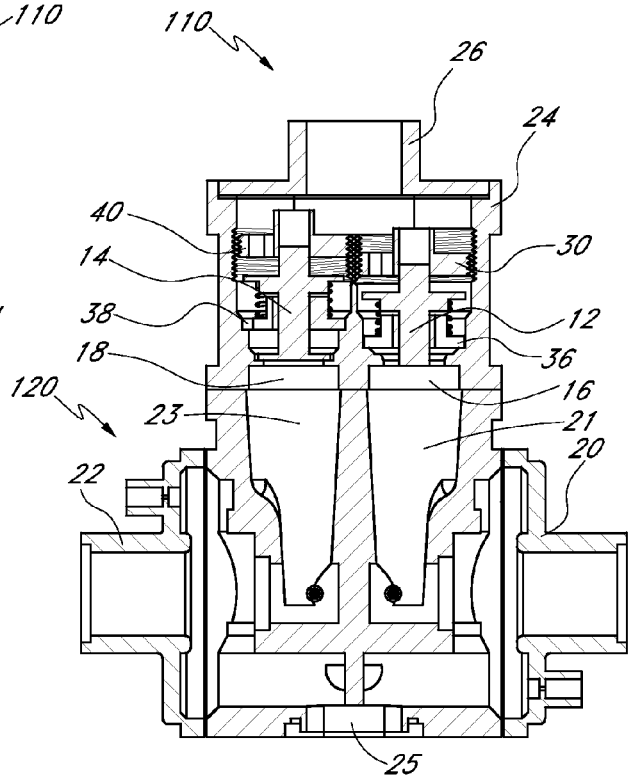
FIG. 8B is a cross-section of the fuel selector valve and pressure regulator of FIG. 8A.

As will be shown hereafter, in the various embodiments, there can be one or more valves, gates, or doors 12, 14 that can function in different ways, as well as one or more channels 16, 18 within the housing 24. The gates, doors or valves 12, 14 can work in many different ways to open or close and to thereby establish or deny access to a channel 16, 18. The channels 16, 18 can direct fluid flow to an appropriate flow passage, such as to the appropriate pressure regulator 20, 22, if pressure regulators are included in the heating assembly (FIGS. 8A-B). For example, channel 16 can direct flow to a first inlet 23 on a regulator 120 that connects to pressure regulator 22 and channel 18 can direct flow to a second inlet 21 that connects to pressure regulator 20. Both pressure regulators 20, 22 can direct flow to the outlet 25. Though a regulator 120 is shown that combines the two pressure regulators 20, 22 into one housing other configurations are also possible.

The shown fuel selector valve 110 of FIGS. 6-8B further includes, biasing members 32, 34, front portions 30, 40 and rear portions 36, 38. Biasing members 32, 34 can be metal springs, elastic, foam or other features used to bias the valves 12, 14 to a particular position, such as being spring loaded to bias both valves 12, 14 to the closed position. Further, the fuel selector valve 110 can be set such that each valve 12, 14 will open and/or close at different pressures acting on the valve. In this way, the fuel selector valve 110 can use fluid pressure to select a flow pathway through the valve. In some embodiments, this can be a function of the spring force of each individual spring, as well as the interaction of the spring with the valve. In some embodiments, the position of the spring and the valve can be adjusted to further calibrate the pressure required to open the valve 12, 14.

For example, the front portions 30, 40 can be threadedly received into the channels 16, 18. This can allow a user to adjust the position of the front portions 30, 40 within the channels and thereby adjust the compression on the spring, as can best be seen in FIG. 7A. In this illustrated embodiment, the spring 32, 34 is located between the valve 12, 14 and the respective rear portion 36, 38. The spring biases the valve to the closed position where it contacts the front portion 30, 40. Each front portion 30, 40 has holes 42 passing through it that are blocked by the valve when the valve is in contact with the front portion. Thus, the adjustment of the position of the front portion with respect to the valve can affect the amount of pressure required to move the valve away from the front portion to open the valve. In some embodiments, the front portions 30, 40 can be adjustable from outside the housing 24. This can allow for the valve 110 to be calibrated without having to disassemble the housing 24. In other embodiments, such as that shown, the front portions 30, 40 can be preset, such as at a factory, and are not accessible from outside the housing 24. This can prevent undesired modification or tampering with the valve 110. Other methods of calibration can also be used.

Figure 7A:
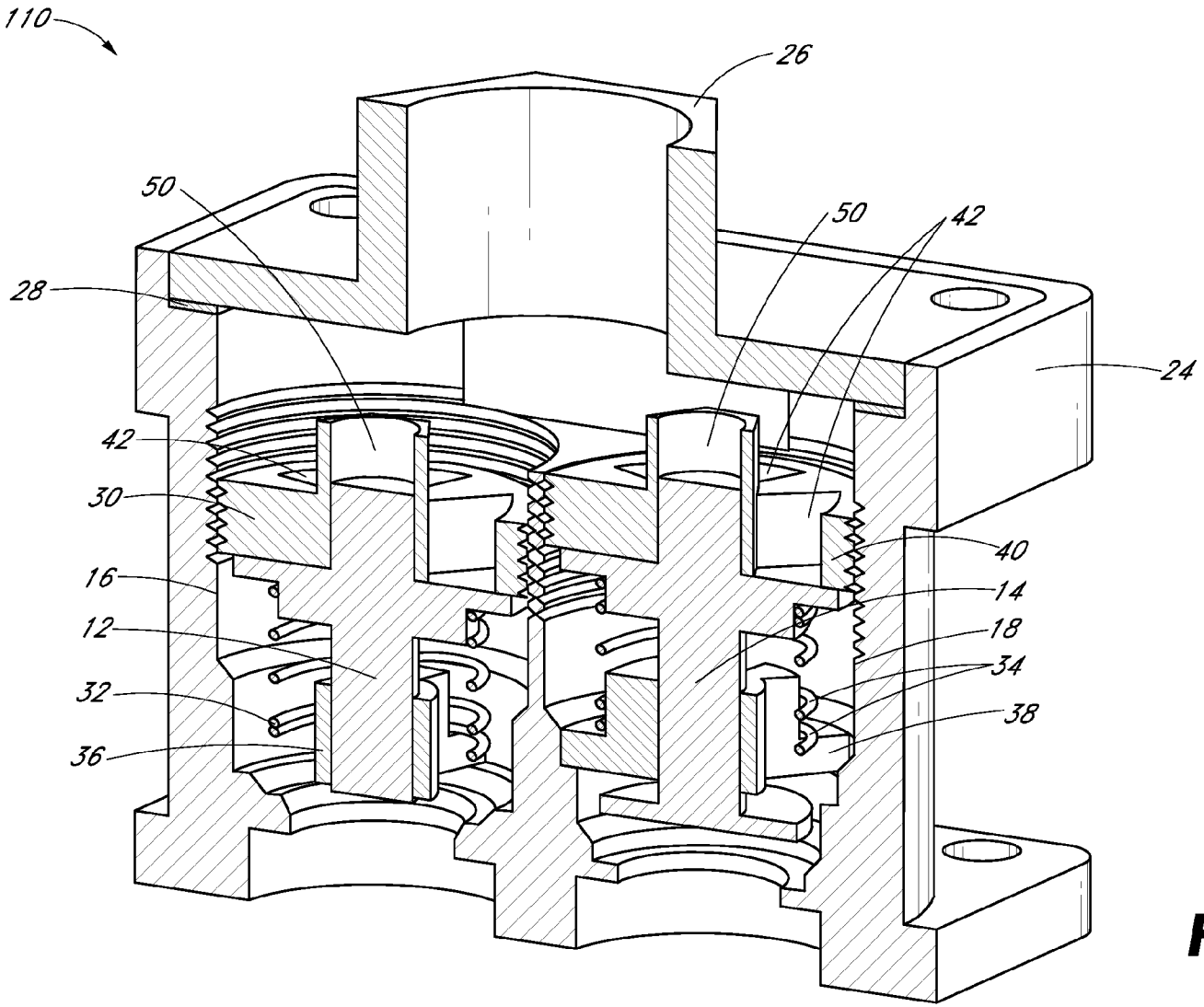
FIGS. 7A-C are cross-sectional views of the fuel selector valve of FIG. 6 in first, second and third positions, respectively.
Figure 7B:
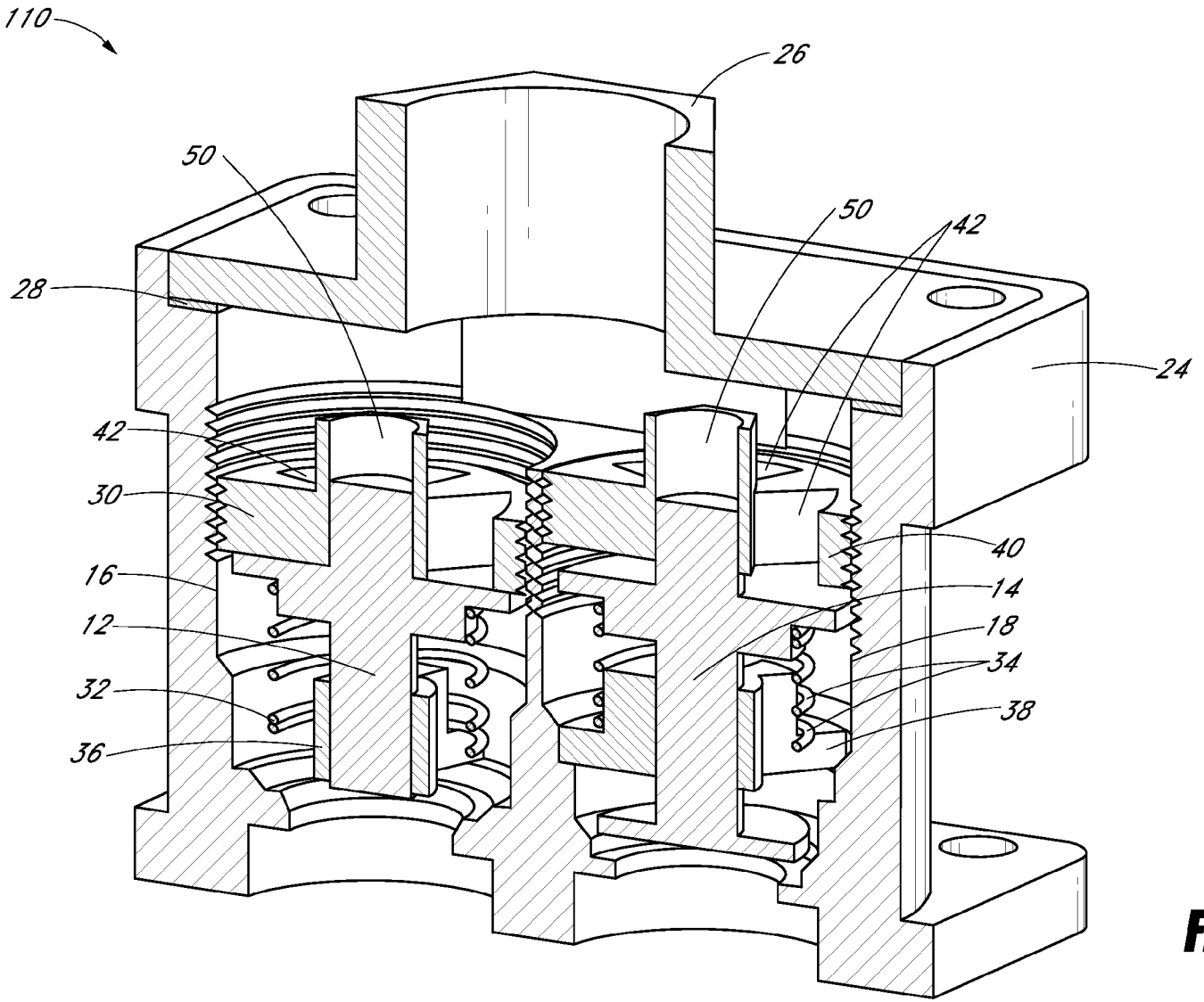

Fluid pressure acting on the valve 12, 14, such as through the holes 42 can force the valve to open. FIG. 7A shows a first open position where a threshold amount of pressure has been achieved to cause the valve 14 to open, while valve 12 still remains closed. FIG. 7B illustrates a second open position where a second threshold pressure has been reached to close valve 14 at the rear end of the valve, and a third threshold pressure has been achieved to open valve 12. In some embodiments, the second and third threshold pressures can be the same. In some embodiments, the third threshold pressure can be greater than the second and the first threshold pressures. Of course, this may change for different configurations, such as where the springs interact and bias the valves in different ways and to different positions.

In some embodiments, the fuel selector valve 110 can be used in a dual fuel appliance, such as an appliance configured to use with NG or LP. In this situation, the first threshold pressure to open valve 14 may be set to be between about 3 to 8 inches of water column, including all values and sub-ranges therebetween. In some embodiments, the first threshold pressure is about: 3, 4, 5, 6, 7 or 8 inches of water column. The second threshold pressure to close valve 14 may be set to be between about 5 to 10 inches of water column, including all values and sub-ranges therebetween. The third threshold pressure to open valve 12 can be set to be between about 8 to 12 inches of water column, including all values and sub-ranges therebetween. In some embodiments, the third threshold pressure is about: 8, 9, 10, 11 or 12 inches of water column. In a preferred embodiment, the first and second threshold pressures are between about 3 to 8 inches of water column, where the second is greater than the first and the third threshold pressure is between about 10 to 12 inches of water column. In this embodiment, as in most dual fuel embodiments, the ranges do not overlap.

Returning now to calibration, for certain springs, as the spring is compressed it can require a greater force to further compress the spring. Thus, moving the front portion 30, 40 away from the respective valve 12, 14 would decrease the force required to initially compress the spring, such as to move the valve 14 from a closed position (FIG. 7A) to an open position (FIG. 7B). The reverse would also be true, moving the front portion closer to the valve would increase the force required to initially compress the spring.

In some embodiments, a spring can be used that has a linear spring force in the desired range of movement, compression or extension, used in the fuel selection valve. The spring force for a particular use of a particular spring can be based on many different factors such as material, size, range of required movement, etc.

Figure 7C:
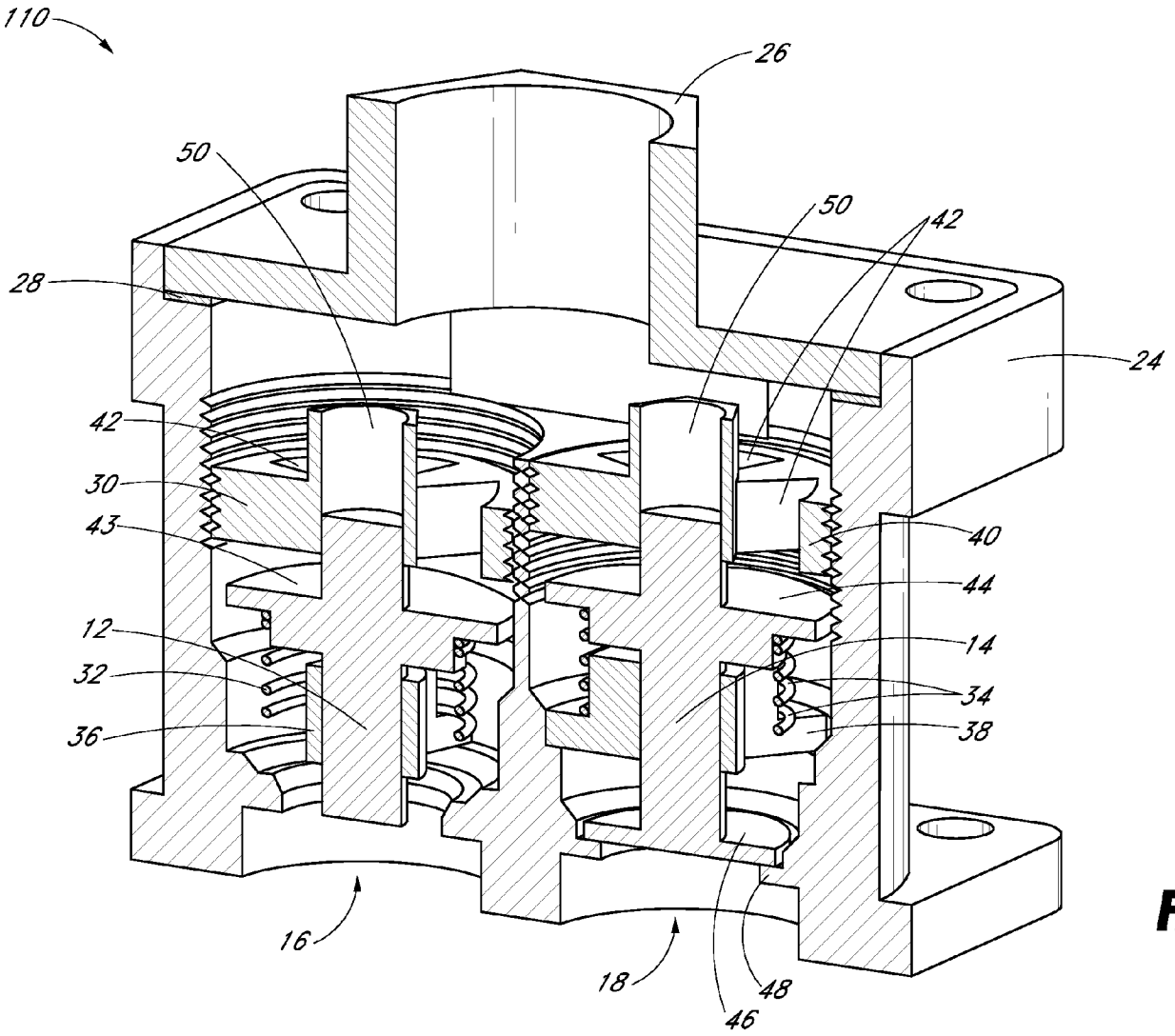

Turning now to FIG. 7C, the valves 12, 14 will now be discussed in more detail. Each valve 12, 14 can form one of more valve seats to prevent fluid flow from passing the valve or to redirect fluid flow in a particular manner. For example, valve 12 has a forward ledge portion 43 and valve 14 has a forward ledge portion 44 and a rearward ledge portion 46, all of which are used to seat the valve 12, 14 against another surface and close the valve. As shown, the forward ledge portions 43, 44 seat with the front portions 30, 40 and the rearward ledge portion 46 seats with a ledge 48 within the outer housing 24. Other configurations are also possible, such as a valve with a portion that seats in multiple locations within the outer housing, for example to have a first closed position, on open position and a second closed position. A front face and a back face of a ledge on a valve could be used to seat the valve, as one further example.

The front 30, 40 and rear 36, 38 portions can be used to position the valve 12, 14 within the housing 24. For example, the rear portions 36, 38 can surround a central region of the valve and the valve can move or slide within the rear portion. Further the spring 32, 34 can be between the valve and the rear portion. The front portions 30, 40 can have one or more holes 42 passing through them. Fluid pressure acting on the valve 12, 14, such as through the holes 42 can force the valve to open. In some embodiments, the front portions 30, 40 can have a channel 50. The channel 50 can be used to guide movement of the valve. In addition, the channel can direct fluid flow at the valve to open the valve. Because there are no exits in the channel, fluid flow does not pass around the valve but rather remains constantly acting against the valve as long as there is flow through the fuel selector valve 110.

In other embodiments, the front and/or rear portions can be permanently or integrally attached to the housing 24. Some embodiments do not have either or both of a front or rear portion.

It will be understood that any of the pressure sensitive valves described herein, whether as part of a fuel selector valve, nozzle, or other component of the heating assembly, can function in one of many different ways, where the valve is controlled by the pressure of the fluid flowing through the valve. For example, many of the embodiments shown herein comprise helical or coil springs. Other types of springs, or devices can also be used in the pressure sensitive valve. Further, the pressure sensitive valves can operate in a single stage or a dual stage manner. Many valves described herein both open and close the valve under the desired circumstances (dual stage), i.e. open at one pressure for a particular fuel and close at another pressure for a different fuel. Single stage valves may also be used in many of these applications. Single stage valves may only open or close the valve, or change the flow path through the valve in response to the flow of fluid. Thus for example, the fuel selector valve 110 shown in FIG. 7A is shown with a single stage valve 12 and a dual stage valve 14. The dual stage valve 14 can be modified so that the valve is open in the initial condition and then closes at a set pressure, instead of being closed, opening at a set pressure and then closing at a set pressure. In some instances, it is easier and less expensive to utilize and calibrate a single stage valve as compared to a dual stage valve.

As discussed previously, the fuel selector valve 110 can be used to determine a particular fluid flow path for a fluid at a certain pressure or in a pressure range. Some embodiments of heating assembly can include first and second pressure regulators 20, 22. The fuel selector valve 110 can advantageously be used to direct fluid flow to the appropriate pressure regulator without separate adjustment or action by a user.

In some embodiments, the first and second pressure regulators 20, 22 are separate and in some embodiments, they are connected in a regulator unit 120, as shown in FIGS. 4A-B & 8A-B. A regulator unit 120 including first and second pressure regulators 20, 22 can advantageously have a two-in, one-out fluid flow configuration, though other fluid flow configurations are also possible including one-in or two-out.

The pressure regulators 20, 22 can function in a similar manner to those discussed in U.S. application Ser. No.

11/443,484, filed May 30, 2006, now U.S. Pat. No. 7,607,426, incorporated herein by reference and made a part of this specification; with particular reference to the discussion on pressure regulators at columns 3-9 and FIGS. 3-7 of the issued patent.

The first and second pressure regulators 20, 22 can comprise spring-loaded valves or valve assemblies. The pressure settings can be set by tensioning of a screw that allows for flow control of the fuel at a predetermined pressure or pressure range and selectively maintains an orifice open so that the fuel can flow through spring-loaded valve or valve assembly of the pressure regulator. If the pressure exceeds a threshold pressure, a plunger seat can be pushed towards a seal ring to seal off the orifice, thereby closing the pressure regulator.

The pressure selected depends at least in part on the particular fuel used, and may desirably provide for safe and efficient fuel combustion and reduce, mitigate, or minimize undesirable emissions and pollution. In some embodiments, the first pressure regulator 20 can be set to provide a pressure in the range from about 3 to 6 inches of water column, including all values and sub-ranges therebetween. In some embodiments, the threshold or flow-terminating pressure is about: 3, 4, 5, or 6 inches of water column. In some embodiments, the second pressure regulator 22 can be configured to provide a second pressure in the range from about 8 to 12 inches of water column, including all values and sub-ranges therebetween. In some embodiments, the second threshold or flow-terminating pressure is about: 8, 9, 10, 11 or 12 inches of water column.

The pressure regulators 20, 22 can be preset at the manufacturing site, factory, or retailer to operate with selected fuel sources. In many embodiments, the regulator 120 includes one or more caps to prevent consumers from altering the pressure settings selected by the manufacturer. Optionally, the heater 100 and/or the regulator unit 120 can be configured to allow an installation technician and/or user or customer to adjust the heater 100 and/or the regulator unit 120 to selectively regulate the heater unit for a particular fuel source.

Figure 9:
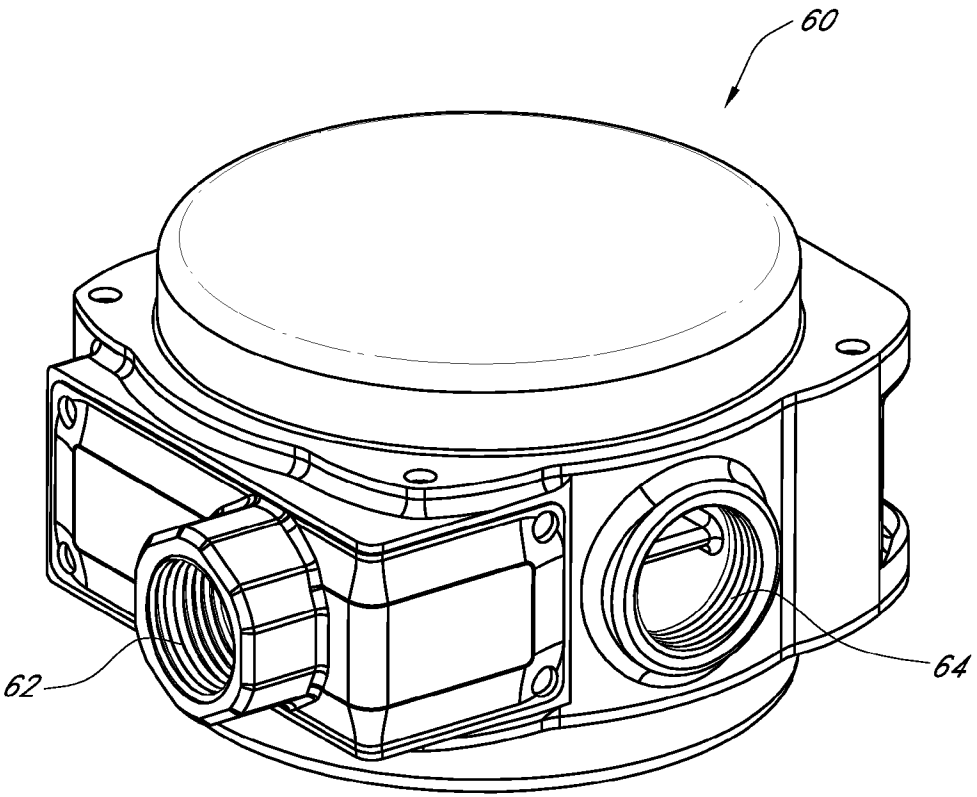
FIG. 9 shows a pressure sensitive pressure regulator.

FIG. 9 shows a pressure sensitive pressure regulator 60. The pressure sensitive pressure regulator can function in a way similar to the combined fuel selector valve and pressure regulator described above but does not require the use of a separate fuel selector valve. The pressure sensitive pressure regulator 60 can be configured such that the pressure of the fluid flow entering the pressure sensitive pressure regulator 60 can determine the pathway through the pressure sensitive pressure regulator 60, of at least two different pathways. In addition, the pathway selected can determine the pressure range in which the pressure sensitive pressure regulator 60 will regulate the fluid flow pressure. For example, where there are two pathways through the pressure sensitive pressure regulator 60, the first pathway can be configured to regulate the fluid flow to exit the pressure sensitive pressure regulator 60 within a first pressure range and the second pathway can be configured to regulate the fluid flow to exit the pressure sensitive pressure regulator 60 with a second pressure range, different from the first.

The pressure sensitive pressure regulator 60 can be used in a device, such as a heating device, system or appliance that is designed for dual or multiple fuel use. As a further example, the pressure sensitive pressure regulator 60 can be used in a dual fuel heater, such as that shown in FIGS. 1-2, or the devices discussed with reference to FIGS. 3A-3B.

The pressure sensitive pressure regulator 60 as shown, has one inlet 62, but can be used to connect to one of many different fuels depending on the need of the end consumer. Thus, if one consumer needs a heater that works with natural gas and another needs one that works with propane, both can purchase the same heater which uses the pressure sensitive pressure regulator 60 that can work with either fuel.

Figure 10:
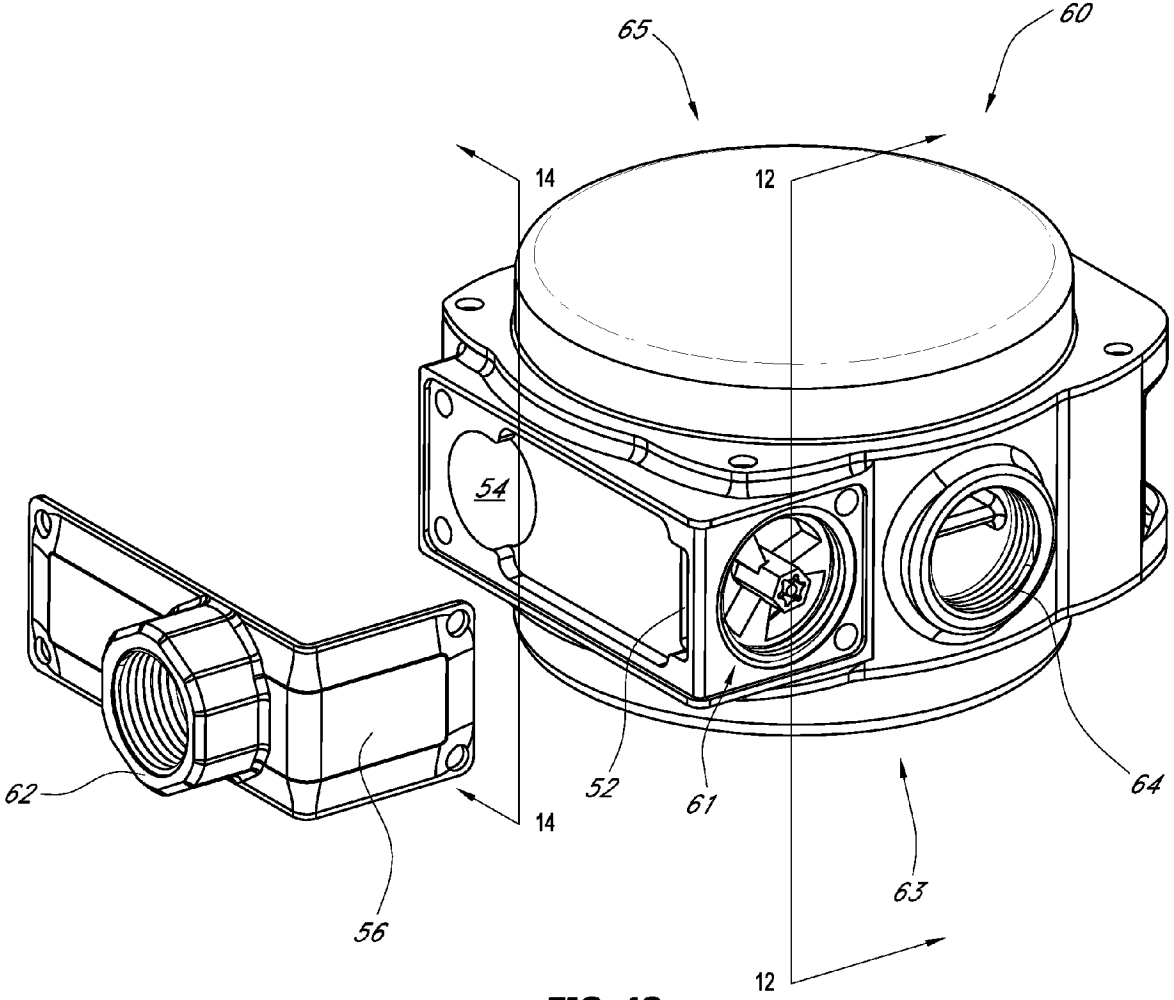
FIG. 10 is a partially exploded view of the pressure sensitive pressure regulator of FIG. 9.

Turning now to FIG. 10, the pressure sensitive pressure regulator 60 is shown with a cap portion 56 removed and spaced from the regulator 60. The cap portion 56 can include the inlet 62. From this view it can be seen that flow entering the inlet 62 will be diverted to two different paths 52, 54. The first path 52 directs flow to a first valve 61. If valve 61 is open, the flow is directed to a second valve 63, which will be explained in more detail below. The second path 54 directs flow to a third valve 65.

Figure 11C:
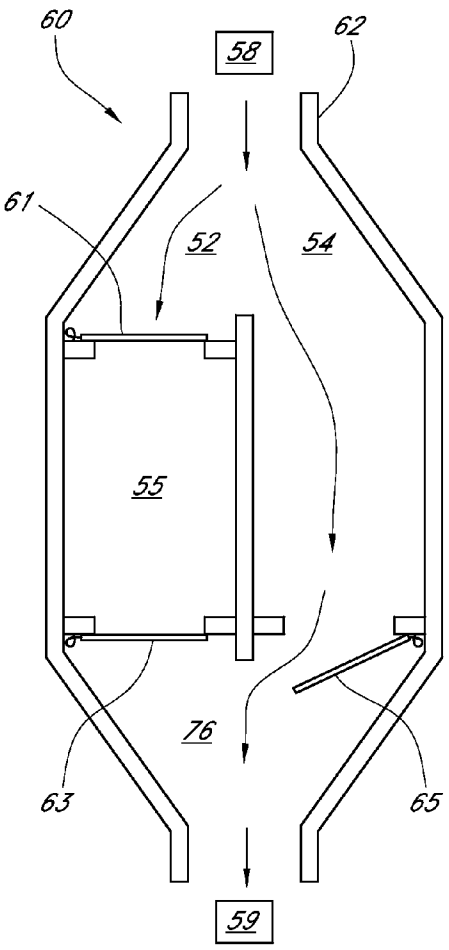
FIGS. 11A-C illustrate a pressure sensitive pressure regulator in an initial position, a first flow position and a second flow position, respectively.
Figure 11B:
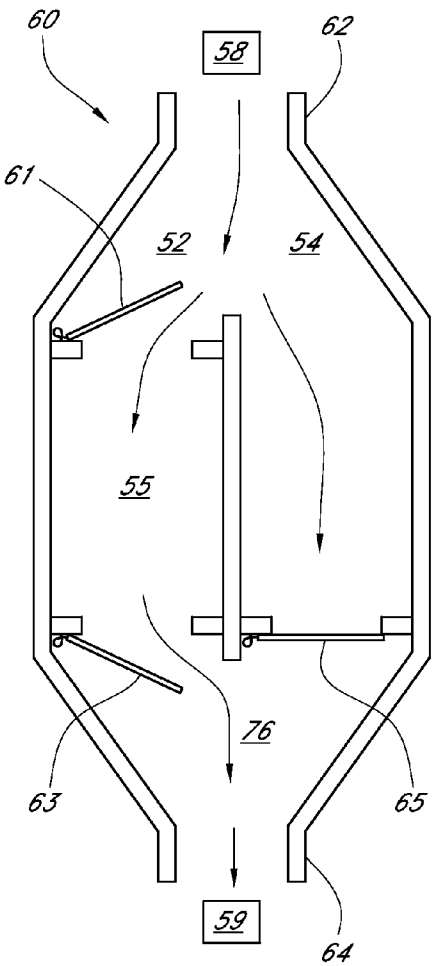
Figure 11A:
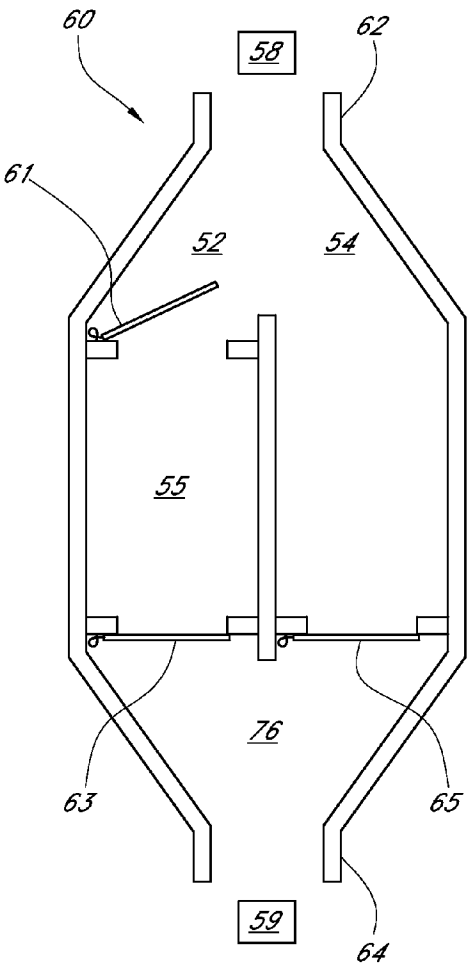

The workings of the pressure sensitive pressure regulator 60 are shown in schematic in FIGS. 11A-C. The pressure sensitive pressure regulator 60 shown functions as follows. The pressure sensitive pressure regulator 60 includes three valves, first valve 61, second valve 63, and third valve 65. In the initial position (FIG. 11A), the first valve 61 is open and the second and third valves, 63 and 65 respectively, are closed. The regulator 60 can be connected to a source of fuel 58 at the inlet 62. The connection to the source of fuel 58 can be a direct connection or can be made through various pipes, lines, channels, etc. The source of fuel 58 can include one of many different types of sources and different types of fuel. For example, the source 58 could be a tank of propane or a natural gas pipeline.

The pressure sensitive pressure regulator 60 can direct a flow of fuel to any of a number of components 59 of a heating system 10. These components 59 can include, among other things, any of the other components described herein, such as control valves, nozzles, burners, ODS, etc.

The pressure of the gas can determine the flow path through the regulator 60. As explained previously, certain gases are typically provided within set pressure ranges. Therefore, the regulator 60 can be set to regulate different fuels depending on their known pressure range. The regulator 60 can be configured such that a first fuel at a first pressure can flow into the regulator 60 through the inlet 62 (FIG. 11B). From the inlet the flow will enter the two paths 52, 54. In some embodiments, the fuel at the first pressure cannot open third valve 65, therefore the fuel will flow through first valve 61 and enter path or area 55. From there the fuel can open and flow through second valve 63 into path 76 and then it can flow out of the regulator through outlet 64. The first pressure can be insufficient to both close first valve 61 and open third valve 65.

The regulator 60 can also be configured such that a second fuel at a second pressure can close first valve 61 and open third valve 65 (FIG. 11C). This second fuel can flow into the regulator 60 through the inlet 62 and into paths 52, 54. Because this fuel is at a higher pressure than the first fuel, it can close first valve 61, thereby preventing access to path 55 and second valve 63. The second fuel can open and flow through third valve 65 to path 76 and can then flow out of the regulator through outlet 64.

The regulator 60 can regulate the pressure of the fluid flowing into the device or appliance depending on the fuel flow path through the regulator. For example, the second and third valves 63, 65 can be diaphragms and/or spring loaded valves similar to those used in conventional pressure regulators to regulate fluid pressure, only allowing fluid to flow through the regulator within set pressure ranges.

One embodiment of a system of valves and flow paths will now be described. Returning to FIG. 10, while also referring to FIGS. 12-13, it can be seen that the inlet 62 can direct fuel through two paths 52, 54. Fuel in path 52 is directed towards first valve 61. The first valve 61 can include a valve member 14' that can function in a similar manner to the valve 14 described above with reference to FIGS. 6-7C. Numerical reference to components is the same as in the previously described arrangement, except that a prime symbol (') has been added to the reference. Where such references occur, it is to be understood that the components are the same or substantially similar to previously-described components.

Figure 12:
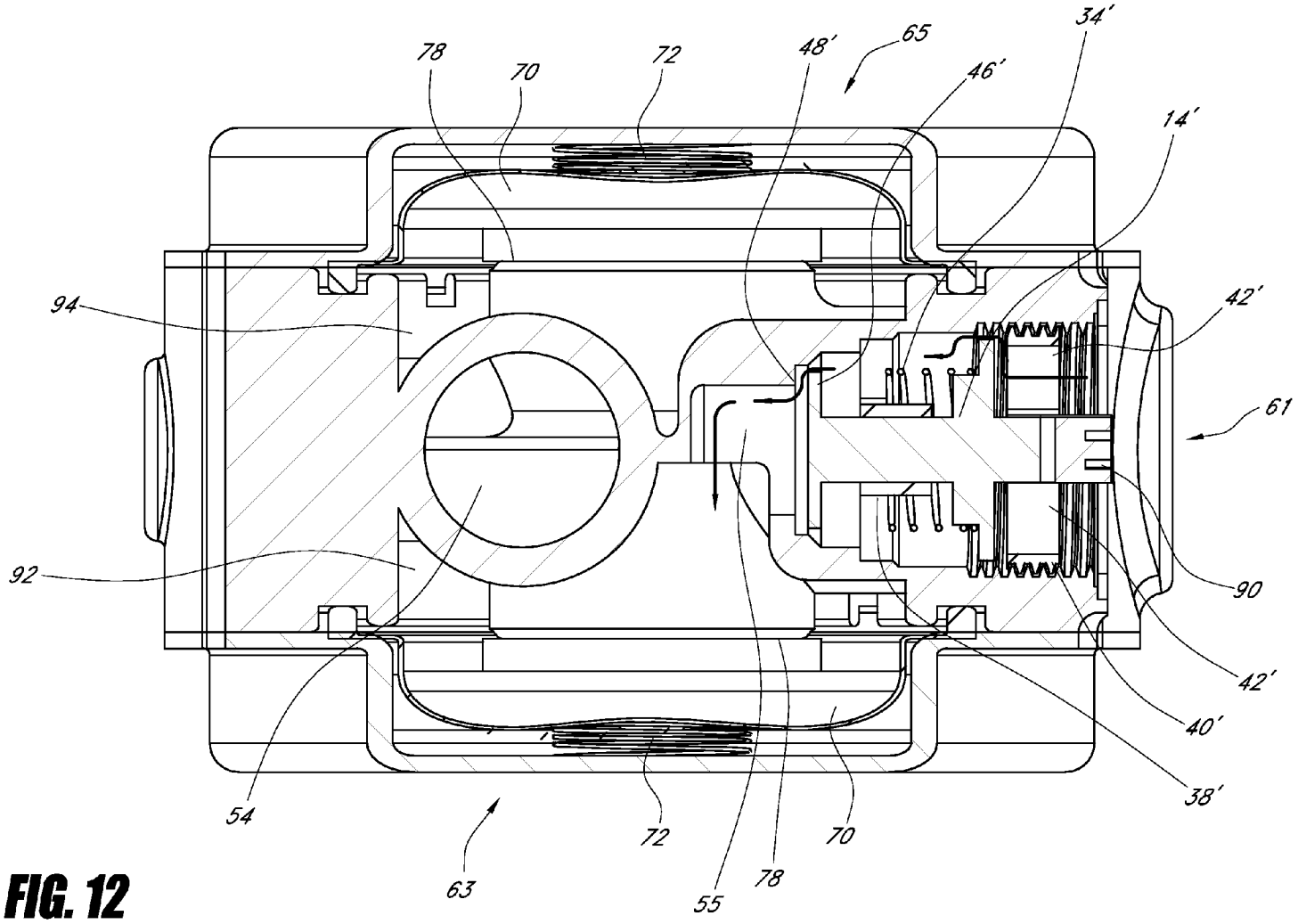
FIG. 12 is a cross sectional view of the pressure sensitive pressure regulator taken along line 12-12 of FIG. 10.
Figure 13:
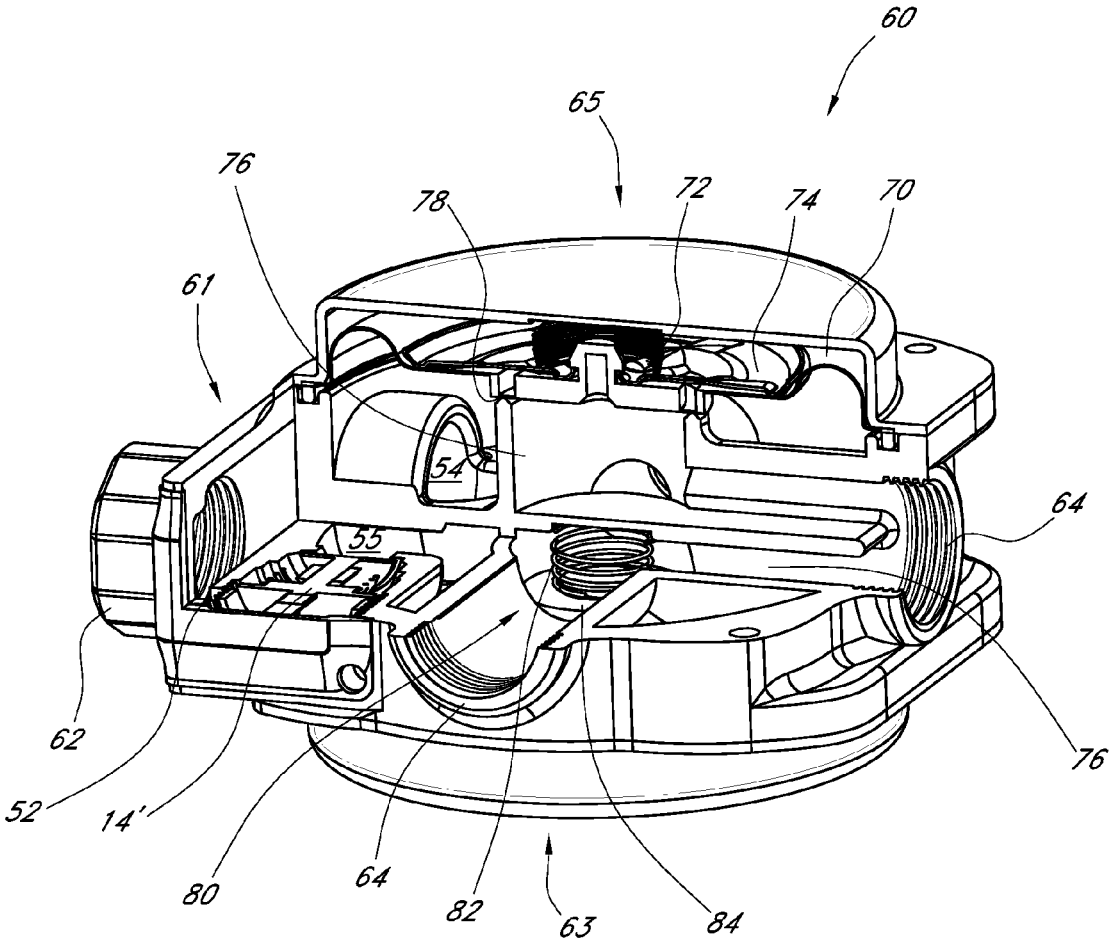
FIG. 13 is a cut away perspective view of the pressure sensitive pressure regulator of FIG. 9.

If first valve 61 and its valve member 14' are open, fluid flow will be directed to path 55. Path 55 directs fuel downward to second valve 63 which, as shown, is located at the bottom of regulator 60. The arrows in FIG. 12 indicate this flow path through first valve 61 and down towards second valve 63. As shown in FIGS. 12-13, the valve 14' is a single stage valve, thus the first valve 61 is open in the initial position and moves to a closed position. The single stage valve can also be used in other configurations, such as a closed to open configuration. Dual stage valves can also be used.

When the fluid pressure of the fuel flow meets or exceeds a threshold valve, the valve member 14' at 46' will be forced into contact with ledge 48' of the housing. This will cause the first valve 61 to close. The first and second valves 61, 63 can be used with a fluid at a lower pressure than the fluid used with third valve 65. Thus, when the fuel at a higher pressure enters the regulator 60, the fluid flow can close first valve 61 through valve member 14'. The fuel can also be at a pressure that can open third valve 65. The second and third valves 63, 65 are explained in more detail below.

As has been mentioned, the inlet directs flow to both paths 52 and 54. Depending on the pressure of the fluid flow, the valve(s) associated with paths 52 and 54 will either be open or closed. Thus, at certain pressures first and second valves 61, 63 will be open and third valve 65 will be closed. In certain other pressures, first and second valves 61, 63 will be closed and third valve 65 will be open.

Figure 14:
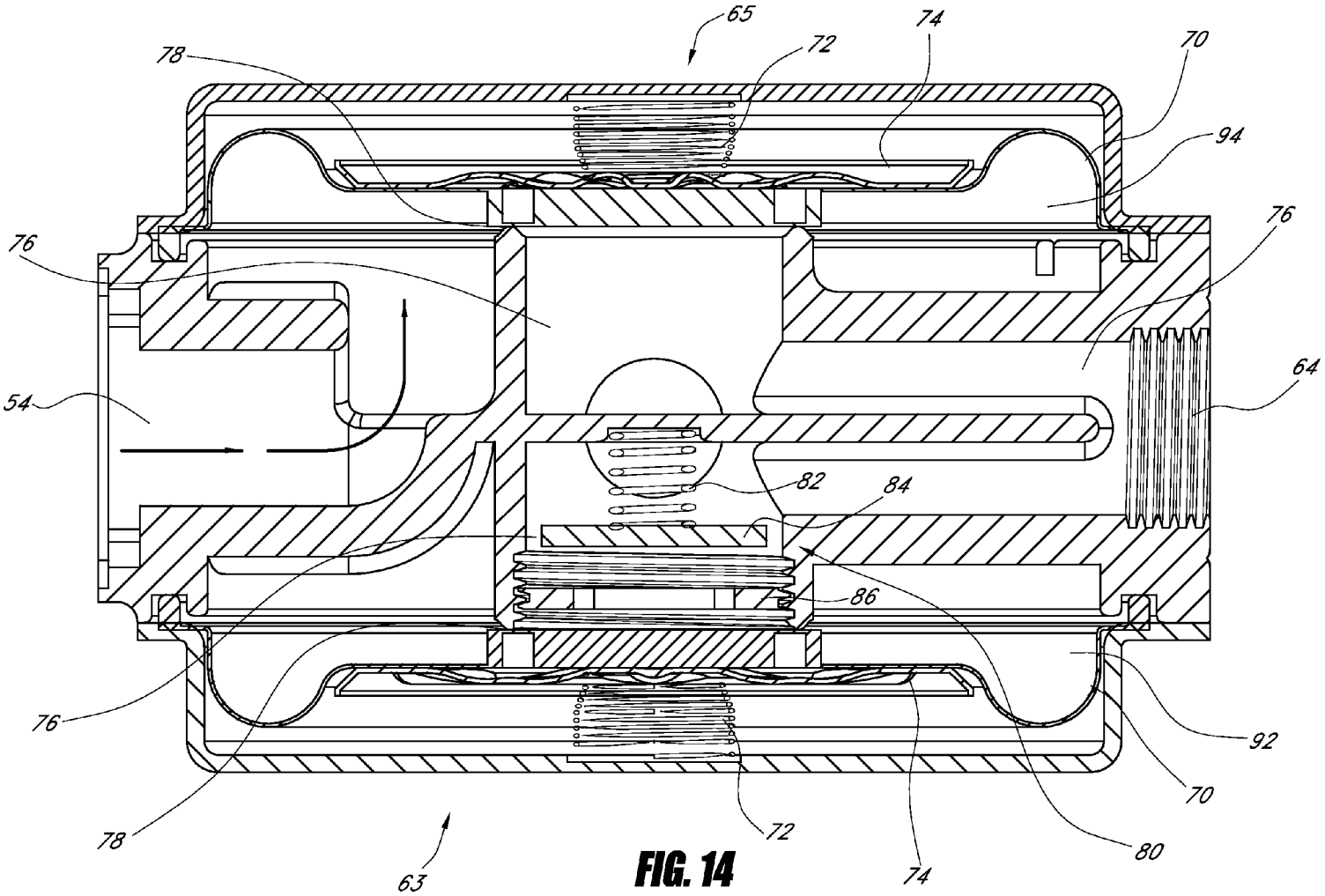
FIG. 14 is a cross sectional view of the pressure sensitive pressure regulator taken along line 14-14 of FIG. 10.

Looking now at path 54 in FIGS. 10, 12-14, path 54 directs flow upward to third valve 65 which as shown, is located at the top of the regulator 60. FIGS. 12 and 14 illustrate how the pressure regulator is essentially divided in half with a bottom chamber 92 and a top chamber 94. Path 54 directs fluid flow into top chamber 94, while fluid flow leaving first valve 61 through path 55 directs fluid flow into the bottom chamber 92.

Figure 15:
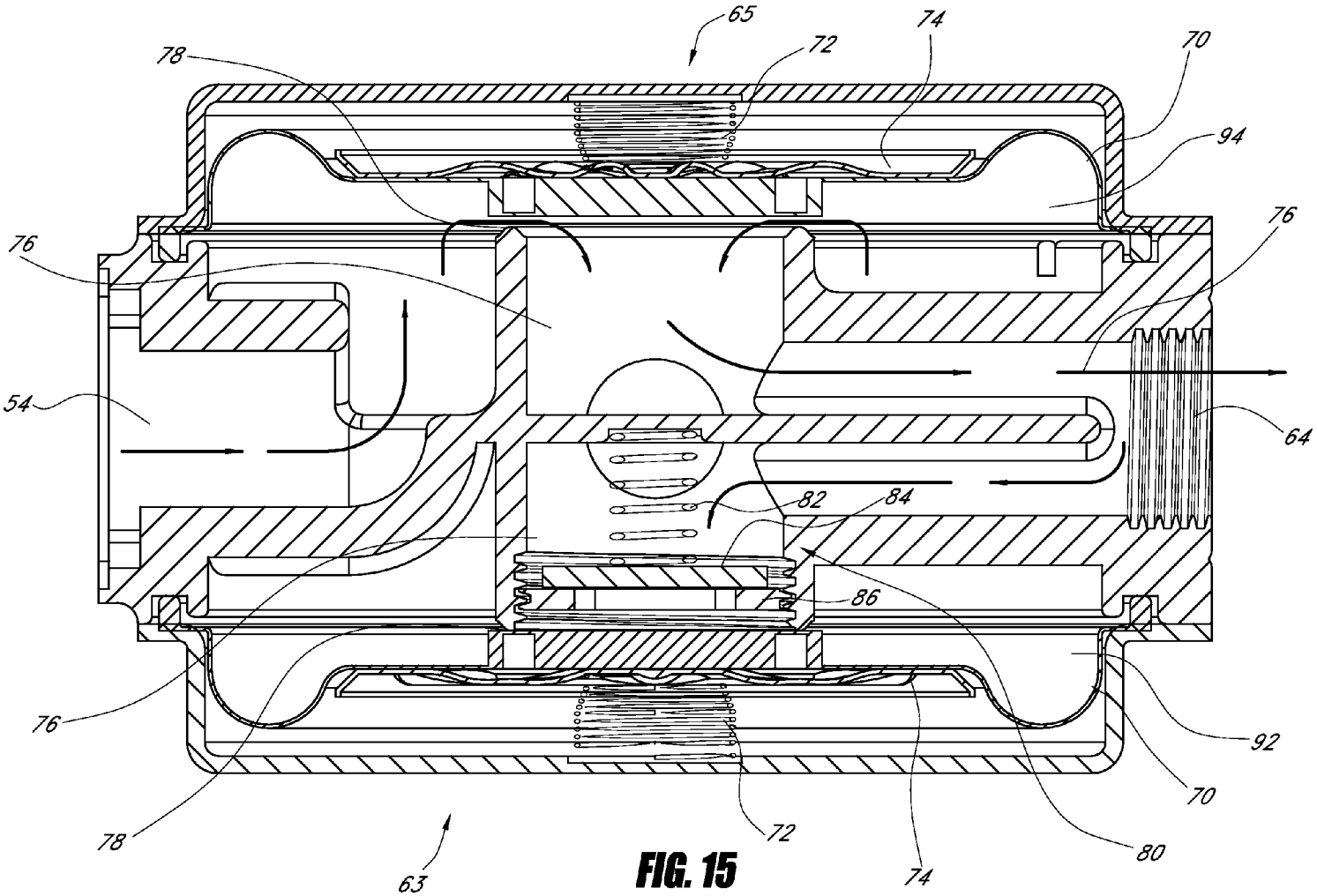
FIG. 15 is a cross sectional view of the pressure sensitive pressure regulator also taken along line 14-14 of FIG. 10.

Second and third valves 63, 65 can both comprise separate diaphragms 70, springs 72 and spring plates 74, which can best be seen with reference to FIGS. 13-15. The diaphragm 70 can contact an exit channel 76 at an interface 78. The third valve 65 with diaphragm 70 will now be described. It will be understood that second valve 63 can work in a similar manner.

When fluid passes through path 54, it will be directed into top chamber 94. The top chamber 94 will begin to fill and in the process the fluid will contact the diaphragm 70. The diaphragm 70, spring 72 and spring plate 74 can be configured such that fluid at a set pressure will cause the diaphragm to move (upwards in FIGS. 14-15), compressing the spring 72. This movement opens the third valve 65 by separating the diaphragm 70 from an interface 78 formed by the diaphragm 70 and the exit channel or path 76. FIG. 15 shows the open third valve 65 with the diaphragm spaced from the exit channel 76 such that fluid can flow into the exit channel and out the outlet 64, as indicated by the arrows.

Referring to FIG. 13, the pressure sensitive pressure regulator 60 has two outlets 64. The outlets 64 can be provided at different locations to facilitate the use of the regulator in different positions and configurations to connect to other components. The outlet(s) 64 that are not being used can be capped. In some embodiments, the pressure sensitive pressure regulator 60 can have only one or more than two outlets 64.

The first and second valves 61, 63 can be used with a fluid at a lower pressure than the fluid used with third valve 65. Thus, when the fuel at a higher pressure enters the regulator 60, the fluid flow can close valve 14'. The fuel can also be at a pressure that can open third valve 65 by moving the diaphragm 70 away from the interface 78 in valve 65.

The regulator 60 can also include one or more one way valves or backflow preventers 80. Such a valve can be used to prevent fuel from flowing back into the regulator 60 through another pathway. For example, third valve 65 can be set to open with a fluid flow at a higher pressure than the fluid flow set to open second valve 63. Thus, when fuel at a higher pressure is flowing through the pressure regulator, it will open third valve 65 and then after the fuel leaves valve 65, it could flow backward into second valve 63, force valve 63 to open and then flow back into the regulator. A one way valve or backflow preventer 80 can be used to prevent fluid from flowing back into the regulator, and in particular can prevent the fluid at a higher pressure exiting third valve 65 from opening second valve 63.

Looking to FIGS. 13-15, it can be seen that the backflow preventer 80 can include a spring 82, a backflow plate 84 and an engagement plate 86. The engagement plate 86 can be threadedly received into the exit channel 76 (FIGS. 14-15). In this way the engagement plate 86 can be used to calibrate the fluid flow pressure required to either or both of open and close the backflow preventer 80. FIG. 15 illustrates with arrows representing the fluid flow, how the flow of fuel leaving third valve 65 can flow to the backflow preventer 80 and close the backflow preventer 80. The flow presses on the backflow plate 84 to overcome the spring force and to force the backflow plate 84 against the engagement plate 86. This closes the backflow preventer 80 and prevents fuel from flowing back into the regulator 60 through the second valve 63.

In some embodiments of pressure regulator, the first valve 61 can be removed and a fuel selection valve 110, such as that shown in FIGS. 6-7C can be added. The fuel selection valve 110 can direct fluid flow to either of valves 63 and 65 depending on the pressure of the fluid flow.

Returning now to FIGS. 3A-4B, fuel selector valves 110 and regulators 120 have been discussed above. As can be seen in the Figures, a heating source may or may not include a fuel selector valve 110 and/or a regulator 120. In some embodiments, a fuel source can be connected to a control valve 130, or the fuel selector valve and/or regulator can direct fuel to a control valve 130. The control valve 130 can comprise at least one of a manual valve, a thermostat valve, an AC solenoid, a DC solenoid and a flame adjustment motor. The control valve 130 can direct fuel to the burner 190 through a nozzle 160. The control valve 130 may also direct fuel to an ODS 180.

The control valve 130 can control the amount of fuel flowing through the control valve to various parts of the heating assembly. The control valve 130 can manually and/or automatically control when and how much fuel is flowing. For example, in some embodiments, the control valve can divide the flow into two or more flows or branches. The different flows or branches can be for different purposes, such as for an oxygen depletion sensor (ODS) 180 and for a burner 190. In some embodiments, the control valve 130 can output and control an amount of fuel for the ODS 180 and an amount of fuel for the burner 190.

In the various embodiments of valves, adjustments can be made to calibrate the valve. For example, in FIGS. 12-13, similar to the discussion with respect to the valve in FIG. 7A, the front portion 40' can be threadedly received into the interior of the housing. Calibrating the valve adjusts the force required to move the valve 14' within the first valve 61. This can be done in many ways, such as by adjusting the position of the valve 14' within the first valve 61 and adjusting the compression or tension on a spring. Here, calibration can adjust the position of the valve body 14' in relation to the front portion 40' while adjusting the amount of force required to act on the spring to move the valve a desired amount. In the example of FIG. 11, the spring biases the valve to an open position and adjusting the position of the front portion can increase or decrease the amount of pressure required to further compress the spring and close the valve to prevent flow through it.

In some embodiments, the position of the rear portion 38', as well as, or in addition to the front portion 40' can be adjusted to calibrate the valve. For example, the rear portion 38' can be threadedly received into the interior of the valve. Further, the front and rear portions can be adjustable from either or both of inside and outside the housing. In some embodiments, the heating assembly can allow for calibration of one or more of the various valves without disassembly of the heating assembly. For example, a detent 90 can be used to adjust the position of the front or rear portion, for example, to receive the head of a screw driver, Allen wrench or other tool. In some embodiments the detent can be accessible from outside the housing.

Advantageously, certain embodiments of the heating assembly as described herein facilitates a single appliance unit being efficaciously used with different fuel sources. This desirably saves on inventory costs, offers a retailer or store to stock and provide a single unit that is usable with more than one fuel source, and permits customers the convenience of readily obtaining a unit which operates with the fuel source of their choice.

Advantageously, certain embodiments of the heating assembly can transition between the different operating configurations as desired with relative ease and without or with little adjustment by an installer and/or an end user. Preferably, a user does not need to make a fuel selection through any type of control or adjustment. The systems described herein can alleviate many of the different adjustments and changes required to change from one fuel to another in many prior art heating sources.

It will be understood that the embodiments and components described herein can be used with, without and/or instead of other embodiments and components as described herein or otherwise. For example, the fuel selector valve described herein can be connected to the regulator 120 of the heater 100 shown in FIGS. 1 and 2.

Reference throughout this specification to "one embodiment" or "an embodiment" means that a particular feature, structure or characteristic described in connection with the embodiment is included in at least one embodiment. Thus, appearances of the phrases "in one embodiment" or "in an embodiment" in various places throughout this specification are not necessarily all referring to the same embodiment. Furthermore, the particular features, structures or characteristics of any embodiment described above may be combined in any suitable manner, as would be apparent to one of ordinary skill in the art from this disclosure, in one or more embodiments.

Similarly, it should be appreciated that in the above description of embodiments, various features of the inventions are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, as the following claims reflect, inventive aspects lie in a combination of fewer than all features of any single foregoing disclosed embodiment. Thus, the claims following the Detailed Description are hereby expressly incorporated into this Detailed Description, with each claim standing on its own as a separate embodiment.

What is claimed is:

1. A dual fuel assembly comprising:

a housing;

an inlet;

an outlet;

a first valve comprising a valve member and a first biasing device;

a second valve comprising a first diaphragm and a second biasing device;

a third valve comprising a second diaphragm and a third biasing device;

wherein the inlet is configured for fluid communication with the first valve and the third valve such that fluid entering the inlet at a first pressure can flow through the first valve to the second valve, open the second valve and flow through the second valve to the outlet, fluid entering the inlet at a second pressure can open and flow through the third valve to the outlet;

wherein the dual fuel assembly is configured such that fluid flowing at the second pressure closes the first valve.

2. The dual fuel assembly of claim 1, wherein the first and second diaphragms are configured to contact the housing to close the second and third valves respectively.

3. The dual fuel assembly of claim 1, wherein the dual fuel assembly is configured such that the fluid flowing at the first pressure is insufficient to open the third valve.

4. The dual fuel assembly of claim 1, further comprising a one way valve to prevent the backflow of fluid into the second valve from the third valve.

5. The dual fuel assembly of claim 1, wherein the first valve further comprising a front portion threadedly received into the housing, the front portion configured to adjust the compression and/or tension on the first biasing member to calibrate the pressure required to close the first valve.

6. The dual fuel assembly of claim 1, wherein the front portion further comprises a detent configured to receive a tool to adjust the position of the front portion.

7. The dual fuel assembly of claim 1, wherein the second pressure is higher than the first pressure.

8. The dual fuel assembly of claim 1, further comprising a burner, a nozzle; and a control valve wherein the outlet of the housing is configured to direct the flow of fluid to the control valve and the control valve is configured to control the flow of fuel to the nozzle for combustion at the burner.

9. The dual fuel assembly of claim 1, wherein the first and second diaphrams are on opposite sides of the housing.

10. The dual fuel assembly of claim 1, wherein the first valve is a normally open valve and the second and third valves are normally closed valves.

11. The dual fuel assembly of claim 10, wherein the first and second valves are configured such that a first minimum pressure is required to open the second valve and a second minimum pressure is required to close the first valve, the second minimum pressure being higher than the first minimum pressure such that only a fluid flow with a fluid pressure between the second minimum pressure and the first minimum pressure can flow through the first and second valves from the inlet to the outlet.

12. The dual fuel assembly of claim 11, wherein the dual fuel assembly is configured such that a third minimum pressure is required to open the third valve, the third minimum pressure being higher than both the first and second minimum pressures.

* * * * *

UNITED STATES PATENT AND TRADEMARK OFFICE

CERTIFICATE OF CORRECTION

PATENT NO. : 9,222,670 B2
APPLICATION NO. : 13/351131
DATED : December 29, 2015
INVENTOR(S) : David Deng It is certified that error appears in the above-identified patent and that said Letters Patent is hereby corrected as shown below:

Claims

In column 14 at line 53, In Claim 9, change “diaphrams” to --diaphragms--.

Signed and Sealed this
Fifth Day of July, 2016

Michelle K. Lee

Michelle K. Lee
*Director of the United States Patent and Trademark Office*